United States Patent [19]

Seals

[11] 3,985,471

[45] Oct. 12, 1976

[54] IMPELLER SHAFT TURNING DEVICE

[75] Inventor: Harold Seals, South Pittsburg, Tenn.

[73] Assignee: Larry Harold Kline, Charleston, S.C.

[22] Filed: July 11, 1974

[21] Appl. No.: 487,819

[52] U.S. Cl. ..... 417/405; 141/68

[51] Int. Cl.[2] ..... F04B 17/00

[58] Field of Search ..... 415/170; 417/405, 406; 60/431, DIG. 2, 468, 493; 141/68; 254/173 R; 137/118; 91/459

[56] References Cited

UNITED STATES PATENTS

| | | | |
|---|---|---|---|
| 932,240 | 8/1909 | Beale et al. | 417/405 |
| 1,070,388 | 8/1913 | Bates | 141/68 |
| 1,366,149 | 1/1921 | Applin | 415/170 A |
| 1,880,895 | 10/1932 | Dorrington et al. | 141/68 |
| 1,948,951 | 2/1934 | Walker | 60/DIG. 2 |
| 2,020,956 | 11/1935 | Norling | 417/406 |
| 2,064,245 | 12/1936 | Dittmar | 141/68 |
| 2,711,077 | 6/1955 | Adams | 60/468 |
| 2,759,702 | 8/1956 | Abraham | 254/173 R |
| 2,973,194 | 2/1961 | Bryan et al. | 137/118 |
| 3,083,780 | 4/1963 | Swenson | 141/68 |
| 3,369,360 | 2/1968 | Biasi | 60/493 |
| 3,818,800 | 6/1974 | Bertaux | 91/459 |

*Primary Examiner*—Henry F. Raduazo
*Attorney, Agent, or Firm*—Larry Harold Kline

[57] ABSTRACT

An impeller shaft turning device is disclosed, for use in rotating the shaft of an impeller within a housing in a revolving machine, to aid in impelling material into a bag, the impeller shaft turning device comprising motor means operative to rotate the shaft of an impeller and hydraulic means operative to control the motor means.

10 Claims, 14 Drawing Figures

IMPELLER SHAFT TURNING DEVICE

This invention relates to bag filling machines and more particularly to a revolving machine for placing material in bags.

Many industries require fluidized or flowing powdery materials, such as cement, fertilizer, lime, clay, and other small granular or powdery fluidized materials, to be placed in bags. The Applicant has invented an improved bagging machine which revolves and which contains many new and useful innovations.

The Applicant is simultaneously filing six patent applications, of which this is one, covering various inventions used in the revolving bagging machine. The features of these inventions are all contained within this patent application.

An object of the present inventions is to produce a revolving bagging machine which can bag various materials at a high rate of speed.

Still another object of these inventions is to provide an automatic means for removing bags from a revolving bagging machine.

A further object of these inventions is to provide for a spill collection device for use with the revolving bagging machine.

Still another object of these inventions is to provide a bagger tank, structurally designed to aid in the bagging process.

Another object of these inventions is to provide sloped guide plate surfaces for forming, both, voids for various purposes and funnels to aid in material flow.

Still another object of these inventions is to provide a revolving means to revolve, both, a bagging machine and a take-off device.

Another object of these inventions is to provide for a take-off device for use with a revolving machine which revolves at a speed proportionate to the speed of the revolving machine.

Still another object of these inventions is to provide for a housing for an impeller which has an enclosure with access means allowing for easy access for maintenance purposes.

Another object of these inventions is to provide an impeller shaft turning device comprising hydraulic means operative to control the motor which rotates the shaft of the impeller.

Still another object of these inventions is to provide a bag housing and filling device which holds the bag, when material is flowing into it, and releases the bag, when material is not flowing into it.

Another object of these inventions is to provide means for use with a bag holding and filling device which will not allow material to flow, if no bag is being held.

These and other objects and features of the invention will be apparent from the following description and appended claims.

Briefly, the invention comprises a machine for placing material in bags comprising machine revolving means operative to revolve the machine, material holding means in which the material may be held, machine support structure operative to physically support the machine, and material bagging means operative to place the material, held in the material holding means, into the bags. The machine may further comprise bag removal means operative to remove the bags from the material bagging means. The bag removal means may be a take-off device. The machine may further comprise a spill collection device operative to collect any of the material which might escape from the material bagging means. The material holding means may comprise a bagger tank. The bagger tank may comprise an outer surface shaped like a cylinder, an inner sloping interior shell surface circular at the top and bottom, and a bottom connecting the outer surface to the inner sloping interior shell surface. The bagger tank may further comprise a plurality of sloped guide plate surfaces, all of which emanate from the bottom and are physically connected to the outer surface and the inner sloping interior shell surface, each of the plurality of sloped guide plate surfaces with another of the plurality of sloped guide plate surfaces form a void in the bagger tank, whereby none of the material may enter. Each of the plurality of sloped guide plate surfaces with still another of the plurality of sloped guide plate surfaces form a funnel through which the material may flow. The machine may further comprise a cover for the bagger tank operative to prevent particles of the material from escaping into the atmosphere. The cover may contain a plurality of feeder holes through which the material may be placed in the bagger tank. The material holding means may further comprise a plurality of feeder means operative to bring the material to the feeder holes to be deposited in the bagger tank. The bottom may contain a plurality of dump openings through which the material may flow into the material bagging means. The machine revolving means may comprise motor means, wheel means operative responsive to the motor means, and machine driving means operative responsive to the wheel means. The wheel means may comprise a sprocket. The machine driving means may comprise a sprocket chain welded to the machine, whereby when the sprocket is moved by the motor means, the sprocket will mesh with the sprocket chain causing the machine to revolve. The motor means may comprise an electrical motor, a speed reducer connected to the electrical motor, and an output shaft emanating from the speed reducer. The material bagging means may comprise a plurality of impellers, a plurality of housings operative to hold the material which flows from the material holding means, a plurality of impeller shafts each operative to support one of the plurality of impellers, a plurality of impeller shaft turning means each operative to turn one or more of the plurality of impeller shafts, and a plurality of bag holding and filling means operative to hold the bags and to fill the bags with the material. The plurality of housings is operative to house one of the plurality of impellers.

The take-off device for use with a revolving machine basically comprises revolving means operative to revolve the take-off device at a speed proportionate to the speed of revolution of the revolving machine, a plurality of bag carrying means operative to support the bags when the bags are taken from the revolving machine, and positioning means operative to place the plurality of bag carrying means in proper position to remove the bags from the revolving machine. The take-off device further comprises removal means, to remove the bags from the plurality of bag carrying means. The revolving means basically comprises motor means, first wheel means physically connected to the output of the motor means and operative to revolve the revolving machine, second wheel means physically connected to the same output of the motor means as is the first wheel means, a center shaft on the take-off device, and shaft driving means connected to the second wheel means and operative to revolve the center shaft of the take-off device. The motor means basically comprises an electrical motor, a speed reducer, and an output shaft emanating from the speed reducer. First and second wheel means are physically connected to the output shaft of the speed reducer. The first wheel means may comprise a sprocket. The second wheel means may comprise a take-off device drive sprocket. The shaft driving means may comprise a center shaft driving wheel means which is attached to the center shaft of the take-off device. A drive chain may be driven by a shaft driving sprocket. The shaft driving means further comprises a drive chain support track and a shaft support structure. The revolving means may revolve the take-off device six times for every one revolution of the revolving machine or may be set up for any multiple of revolutions desired. The plurality of bag carrying means comprises an outer shaft and a plurality of holding means connected to the outer shaft. The plurality of holding means basically comprises a plurality of cradle arm supports, a plurality of swivel connections, and a plurality of bag cradles each connected to one of the plurality of swivel connections. The plurality of bag cradles may comprise a plurality of cradle support sides and a plurality of back and side arms. The plurality of bag cradles further comprises a plurality of cradle lifters, two of each being connected to two of the plurality of back and side arms which are connected to one of the plurality of cradle support sides. The plurality of holding means further comprises a plurality of cradle arm braces. The plurality of holding means further comprises a plurality of rigid supports. The positioning means basically comprises movement allowing means which is operative so that the plurality of bag carrying means revolves with the take-off device proportionate to the speed of revolution of the revolving machine, but allows each of the plurality of bag carrying means to be capable of movement up and down. The positioning means further comprises up and down movement means operative to move the plurality of bag carrying means up and down. The up and down movement means basically comprises a base located at the bottom of the take-off device and circling the take-off device, and guiding track resting on the base. The up and down movement means further comprises a plurality of wheels which are operative to ride on the guiding track. The guiding track is structured to provide up and down movement of the plurality of wheels. The guiding track is structured so that a graph of movement of any one of the plurality of wheels versus the time of movement would be a sinusoidal graph. Movement allowing means basically comprises a slot located in the outer shaft and a key located on the center shaft and fitting through the slot on the outer shaft, whereby the key causes the outer shaft to revolve with the center shaft, but allows up and down movement of the outer shaft along the slot. The take-off device may be located with respect to the revolving machine so that each pair of the plurality of cradle lifters on the take-off device may remove a bag from one of a plurality of bag supports on the revolving machine. The cradle lifters will go underneath the bag which is resting on the stool and stool supports, and due to the up and down movement will lift the bag from the stool and stool support and carry it around the take-off device.

The housing for the impeller, which is mounted on the impeller shaft and is capable of moving material, basically comprises an enclosure within which the impeller, mounted on the impeller shaft, may be placed. The enclosure has a plurality of shaft openings through which the impeller shaft may extend. A plurality of shaft opening packing means or gland nuts are secured to the enclosure at each of the plurality of shaft openings. A plurality of packing material, such as wool or fiber packing, is placed within each of the plurality of shaft opening packing means and around the impeller shaft. The molded top of the impeller housing has an opening through which material may be placed in the enclosure or impeller housing. The molded top with the opening comprises material entrance means. Material exit means comprises a spout opening through which material may exit from the housing. Access means in the enclosure allows access for maintenance purposes within the enclosure. Access means comprises an access door, attachment means connecting the access door to the enclosure and securing means holding the access door onto the enclosure. The attachment means comprises a hinge which connects the access door to the enclosure or impeller housing. The securing means comprises a bracket and a securing or opening bolt. The access means further comprises sealing means to keep any of the material from escaping through the access door. The sealing means comprises a gasket. The securing means further comprises an impeller housing support molded onto the enclosure and a plurality of mounting bolts to secure the bracket to the impeller housing support.

The spill collection device for the revolving machine, which bags material, includes material landing means located below the position in the revolving machine where the material is bagged. The excess material will fall onto the material landing means. Material collection means is operative to collect the material which falls onto the material landing means. Material return means is operative to return the excess material which falls onto the material landing means to the revolving machine. The material collection means comprises a plurality of collectors, and a plurality of collector drag means. The material collection means further comprises a plurality of sweep means. The plurality of sweep means may comprise a plurality of sweep arms. The material collection means further comprises a plurality of sweep drag means. The material collection means further comprises a plurality of balance means, each connected to one of the plurality of collectors and operative to maintain proper balance for the plurality of collectors. Cone drag bars comprise a plurality of balance means. The plurality of collectors may comprise a plurality of cones. The plurality of collector drag means may comprise a plurality of chains. The plurality of sweep means may comprise a plurality of sweep arms. The plurality of sweep drag means may comprise a plurality of chains. The plurality of balance means may comprise a plurality of drag bars. The material landing means may comprise a circular trough, a circular inner sloping surface connected to the trough, and a circular outer sloping surface connected to the side of the trough opposite from the inner sloping surface. The plurality of cones is dragged through the circular trough. The plurality of sweep arms is dragged on the surface of the circular outer sloping surface. The material return means may comprise a plurality of spill removal holes, a plurality of spill removal means, and a plurality of elevating means. The spill removal holes are located in the material landing means. The plurality of spill removal means may be a plurality of conveyors. The plurality of elevating means, which are operative to elevate the excess material and return the excess material to the revolving machine, may be a plurality of elevators.

The plurality of impeller shaft turning devices is used to turn the various impellers in the invention. Looking at one impeller shaft turning device, it is used in rotating the shaft of an impeller within a housing in a revolving machine, to aid in impelling material into a bag. The impeller shaft turning device comprises motor means operative to rotate the shaft of an impeller, and hydraulic means operative to control the motor means. The motor means may be a hydraulic motor. The hydraulic means may comprise a fluid supply means which provides a flow of fluid to the hydraulic means, start and stop control means operative to start and stop the flow of the fluid to the hydraulic motor, and flow control means operative to control the quantity of fluid to the hydraulic motor after the start and stop control means allow flow of the fluid to the hydraulic motor, whereby the flow control valve controls the speed of rotation of the shaft. The impeller shaft turning device has hydraulic means further comprising pressure relief means operative to maintain constant speed of the hydraulic motor when a plurality of hydraulic motors is operated using the same fluid supply means. The start and stop control means may comprise a directional control valve. The flow control means may comprise a flow control valve. The fluid supply means may comprise a pressure header from which fluid flows to the hydraulic motor and a return header to which fluid flows from the hydraulic motor. The start and stop control means may comprise starting means operative to start the flow of fluid to the hydraulic motor and stopping means operative to stop the flow of fluid to the hydraulic motor. The starting and stopping means, both, may comprise a solenoid. Both the start and stop solenoids may be activated by microswitches. The start solenoid may be activated by a microswitch located on the revolving machine, when the shaft of an impeller should be rotated to aid the revolving machine to impel the material into the bag. The stop solenoid may be activated by a microswitch located on the revolving machine when a pre-determined amount of the material has entered the bag. The pre-determined amount may be determined by a scale beam balance scale system. The flow control means is adjustable to control the flow of the fluid to the hydraulic motor to a predetermined amount per time interval and is thereby operative to control the speed of the hydraulic motor to a pre-determined speed and to be adjusted to control the speed of the hydraulic motor to aid in impelling the material into the bag, which may be necessitated by material of varying particle size and by atmospheric conditions. The fluid supply means may comprise a fluid source means operative to provide a source of fluid, a pressure header from which the fluid may flow to the hydraulic motor, and a return header to which fluid may flow from the hydraulic motor. The fluid source means may comprise a hydraulic pump means connected to the pressure header and operative to pump the fluid to the pressure header, pump motor driving means operative to control the hydraulic pump means, a reservoir operative to hold a supply of fluid, pressure relief means connected to said hydraulic pump means and operative to relieve pressure, and cooling means connected to the return header and operative to cool the fluid when it is returned to the reservoir from the return header. The pump motor driving means may comprise an electrical start and stop switch. The fluid source means further comprises a suction strainer located between the hydraulic pump and the reservoir operative to strain the fluid. The fluid source means may further comprise a filter located between and connected to the return line header and the reservoir to aid in purifying the fluid being returned to the reservoir. The cooling means may comprise a heat exchanger. The pump motor driving means may be an electrical motor. The impeller shaft turning device may further comprise a coupling connected to the output of the motor means and connecting to the shaft of the impeller. The impeller shaft turning device may further comprise a universal joint operative to connect the shaft of an impeller to a second shaft of another impeller, whereby the second shaft of another impeller may be rotated by the same motor means as the shaft of an impeller. The impeller shaft turning device is a sealed system and is impervious to dust and atmospheric conditions.

The revolving machine comprises a plurality of bag holding and filling devices, for placing material into bags. A bag holding and filling device, for placing material into a bag, comprises bag clamping means operative to hold the bag onto the device and pinch means physically connected to the bag clamping means operative to control the flow of the material into the bag, whereby when the pinch means allows the material to flow into the bag, the bag clamping means will hold the bag onto the device and when the pinch means does not allow the material to flow into the bag, the bag clamping means will release the bag. The bag holding and filling device further comprises bag insert interlock contact means operative to cause the pinch means not to allow the material to flow when no bag is being held by the bag clamping means. The bag holding and filling device further comprises weight evaluating means operative when the material in the bag reaches a predetermined weight to activate the pinch means to stop the flow of the material into the bag. The bag holding and filling device further comprises a material flow hose through which the material flows. When the material flow hose is pinched and the material is stopped from flowing by the pinch means, the pinch means operates to stop the flow of material into the bag. The bag holding and filling device further comprises a spout connected to the material flow hose through which the material flows into the bag. The pinch means may be a pinch valve mechanism. The pinch valve mechanism may comprise an air cylinder, an air cylinder control valve operative to control the air cylinder, and a plurality of linkage bars operative responsive to the air cylinder, whereby when the pinch means operates to stop the flow of the material into the bag, the plurality of linkage bars pinches the material flow hose. The bag clamping means comprises a clamping mechanism apparatus operative to clamp the bag against the spout when the bag clamping means is holding the bag onto the device. The bag holding and filling device further comprises a lever rod connected to one of the plurality of linkage bars and to the clamping mechanism apparatus, whereby when the pinch means operates to allow flow of the material into the bag, the lever rod is positioned to press the clamping mechanisms against the spout. The bag insert interlock contact means may comprise an electrical contact in the clamping mechanism apparatus, whereby when the clamping mechanism apparatus is pressed against the spout, an electrical connection is made, and a bag insert interlock solenoid valve activated when the electrical contact makes an electrical connection with the spout and operative to activate the air cylinder control valve to cause the plurality of linkage bars to pinch the material flow hose and stop the flow of material, whereby the material will not flow unless a bag, acting as an insulator, prevents an electrical connection between the electrical contact and the spout. The bag holding and filling device further comprises bag support means operative to hold the bag to be filled with the material. The bag support means may comprise a bag channel support connected to the revolving machine, stool support apparatus connected to the bag channel support, and a stool connected to the stool support apparatus operative to hold a bag to be filled with the material. The stool support apparatus may comprise a stool support arm connected to the bag channel support, an adjusting stool support connected to the stool and adjustably connected to the stool support arm, and a plurality of height adjusting nuts operative to hold the adjusting stool support at a pre-determined height, whereby a bag may be placed on the stool and may be raised or lowered by the adjusting stool support to be properly positioned to receive the material into the bag.

The invention will be more fully understood from the following detailed description and appended claims when taken with the drawings in which:

Figure 1:
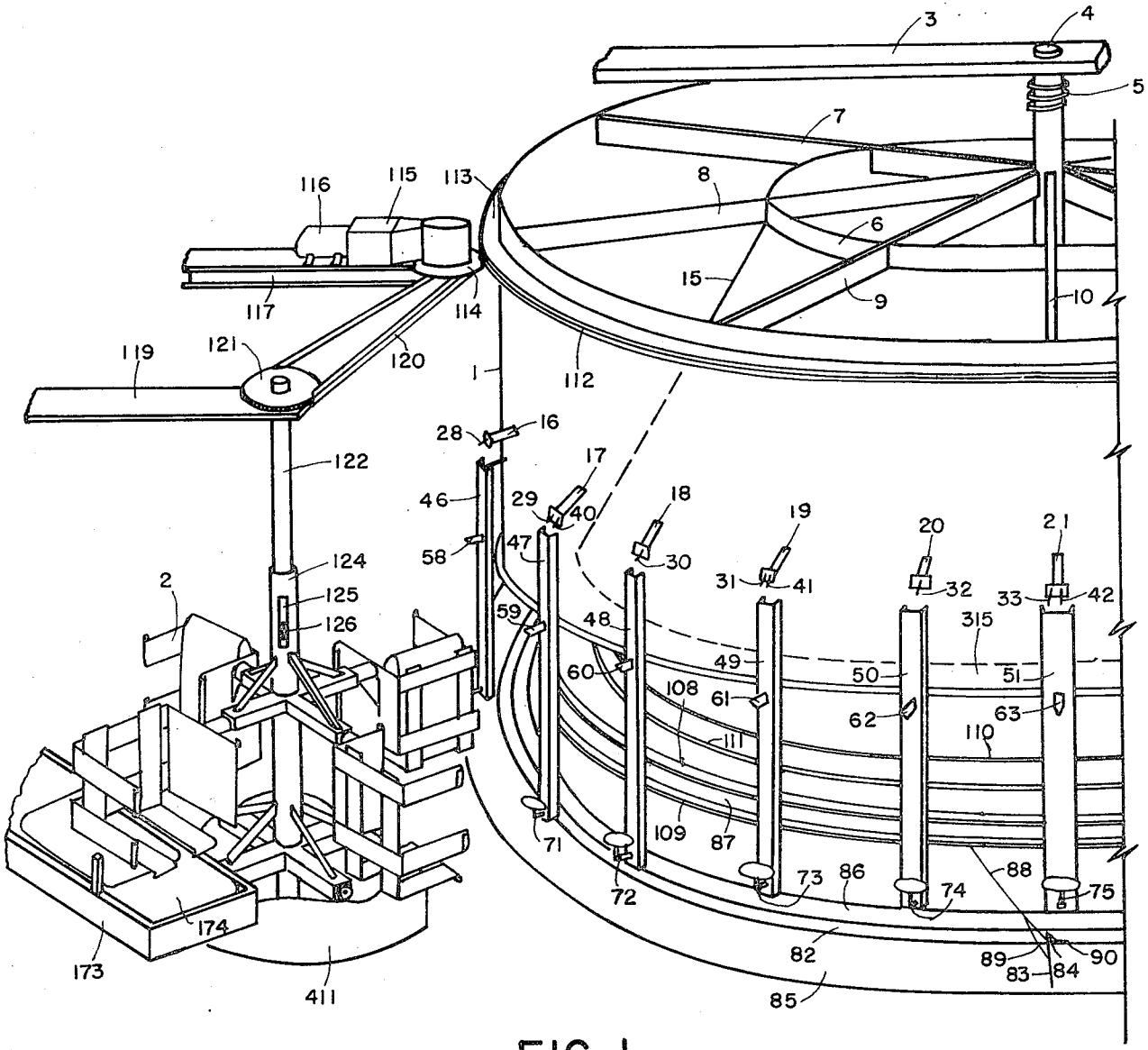
FIG. 1 is a perspective view of one side of the bagging machine, without the cover on the bagger tank, further showing the take-off device and drive mechanisms.
Figure 2:
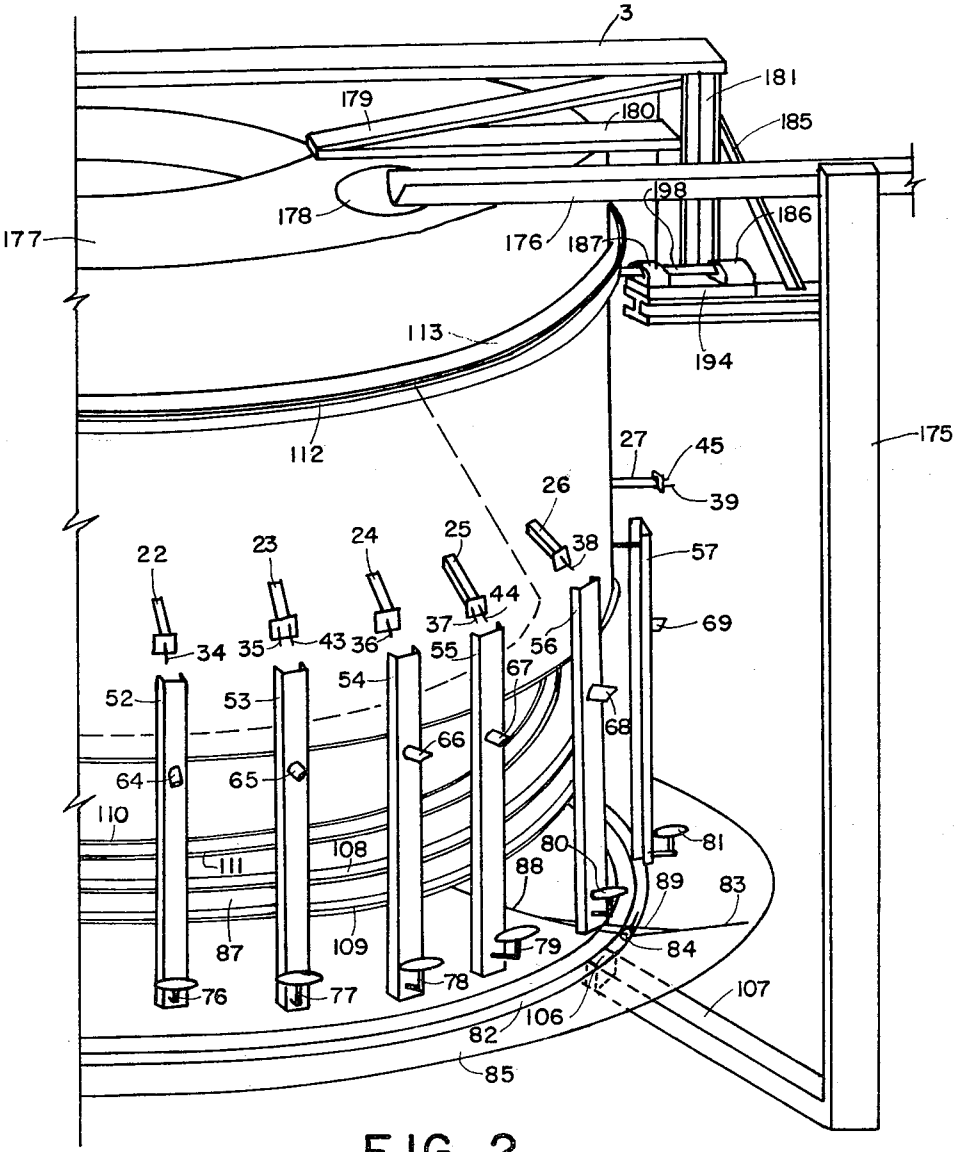
FIG. 2 is a perspective view of the other side of the bagging machine showing the cover and one feed conveyor.

Referring now to the drawings, FIG. 1 is a perspective view of one side of the bagging machine, without the cover on the bagger tank, further showing the take-off device and drive mechanisms. FIG. 2 is a perspective view of the other side of the bagging machine showing the cover and one feed conveyor. FIGS. 1 and 2 will be discussed together.

The complete bagging machine consists of many individual structural pieces, an upper supporting structure 3 comprises upper support to which the center shaft 4 of the bagging machine is attached. Electrical brush rigging 5 is attached onto center shaft 4 of the bagging machine. Supporting beams 7, 8, 9, 10, 11, 12, 13, and 14 (see FIG. 3) emanate from the center shaft 4. The bagger tank is formed with outside cylindrical surface 1, inner sloping interior shell surface 15, and bottom 315. Inside rim 6 of the shell structure rests on top of the sloping interior shell surface 15 of the bagger tank. Supporting beams 7, 8, 9, 10, 11, 12, 13, and 14 are physically connected to the inside of outer surface 1, the inside rim 6, and the top of sloping interior shell surface 15 for purposes of stability. For further support, supporting beam 7 is attached to structural support 219, supporting beam 9 is attached to structural support 218, supporting beam 11 is attached to structural support 221, and supporting beam 13 is attached to structural support 220.

FIG. 2 is shown with a cover 177 on the bagger tank. Attached to outer surface 1 of the bagger tank are various supports for pinch valve air start control valves and hydraulic motor start microswitches. Support 16 supports air start valve 28, support 17 supports air start valve 29 and start microswitch 40, support 18 supports air start valve 30, support 19 supports air start valve 31 and start microswitch 41, support 20 supports air start valve 32, support 21 supports air start valve 33 and start valve 33 and start microswitch 42, support 22 supports air start valve 34, support 23 supports air start valve 35 and start microswitch 43, support 24 supports air start valve 36, support 25 supports air start valve 37 and start microswitch 44, support 26 supports air start valve 38, support 27 supports air start valve 39 and start microswitch 45.

On this bagging machine which has 24 spouts, 12 more supports, such as supports 16, 17, 18, 19, 20, 21, 22, 23, 24, 25, 26, and 27, will be located on the back of the bagging machine, not shown in FIGS. 1 and 2. Below each support 16, 17, 18, 19, 20, 21, 22, 23, 24, 25, 26, and 27 is a bag channel support and a spout. Below support 16 is bag channel support 46 and spout 58, below support 17 is bag channel support 47 and spout 59, below support 18 is bag channel support 48 and spout 60, below support 19 is bag channel support 49 and spout 61, below support 20 is bag channel support 50 and spout 62, below support 21 is bag channel support 51 and spout 63, below support 22 is bag channel support 52 and spout 64, below support 23 is bag channel support 53 and spout 65, below support 24 is bag channel support 54 and spout 66, below support 25 is bag channel support 55 and spout 67, below support 26 is bag channel support 56 and spout 68, and below support 27 is bag channel support 57 and spout 69.

Figure 9:
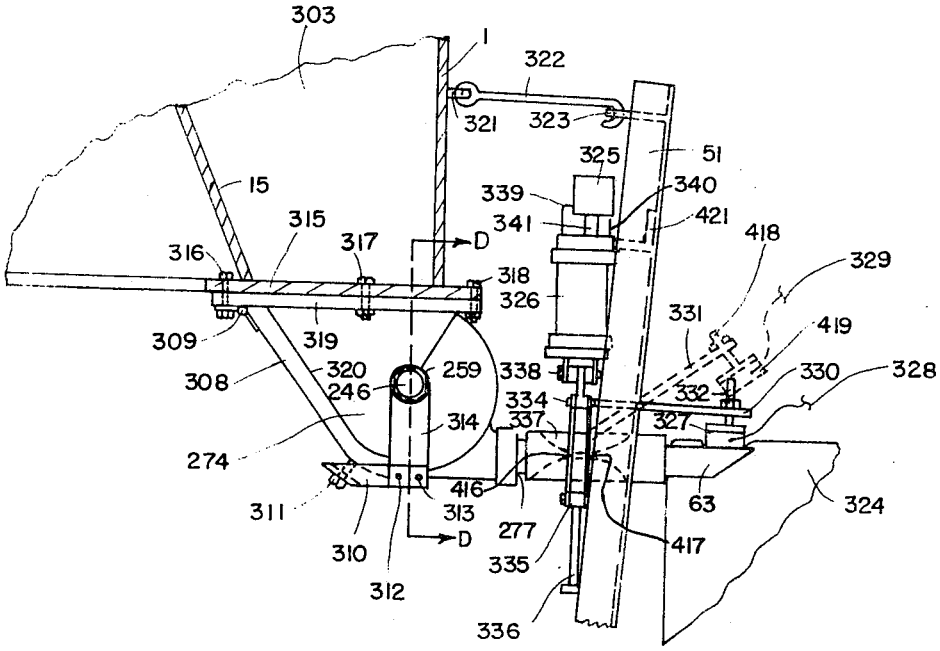
FIG. 9 is an elevation view taken from the side of impeller housing 274, further showing the associated bag clamping mechanisms.
Figure 10:
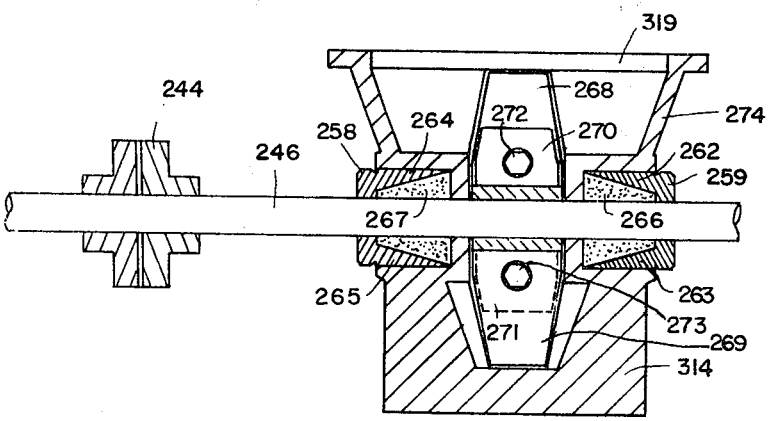
FIG. 10 is a section view taken at points D—D in FIG. 9, which is from the rear of impeller housing 274, showing the interior of said impeller housing.
Figure 11:
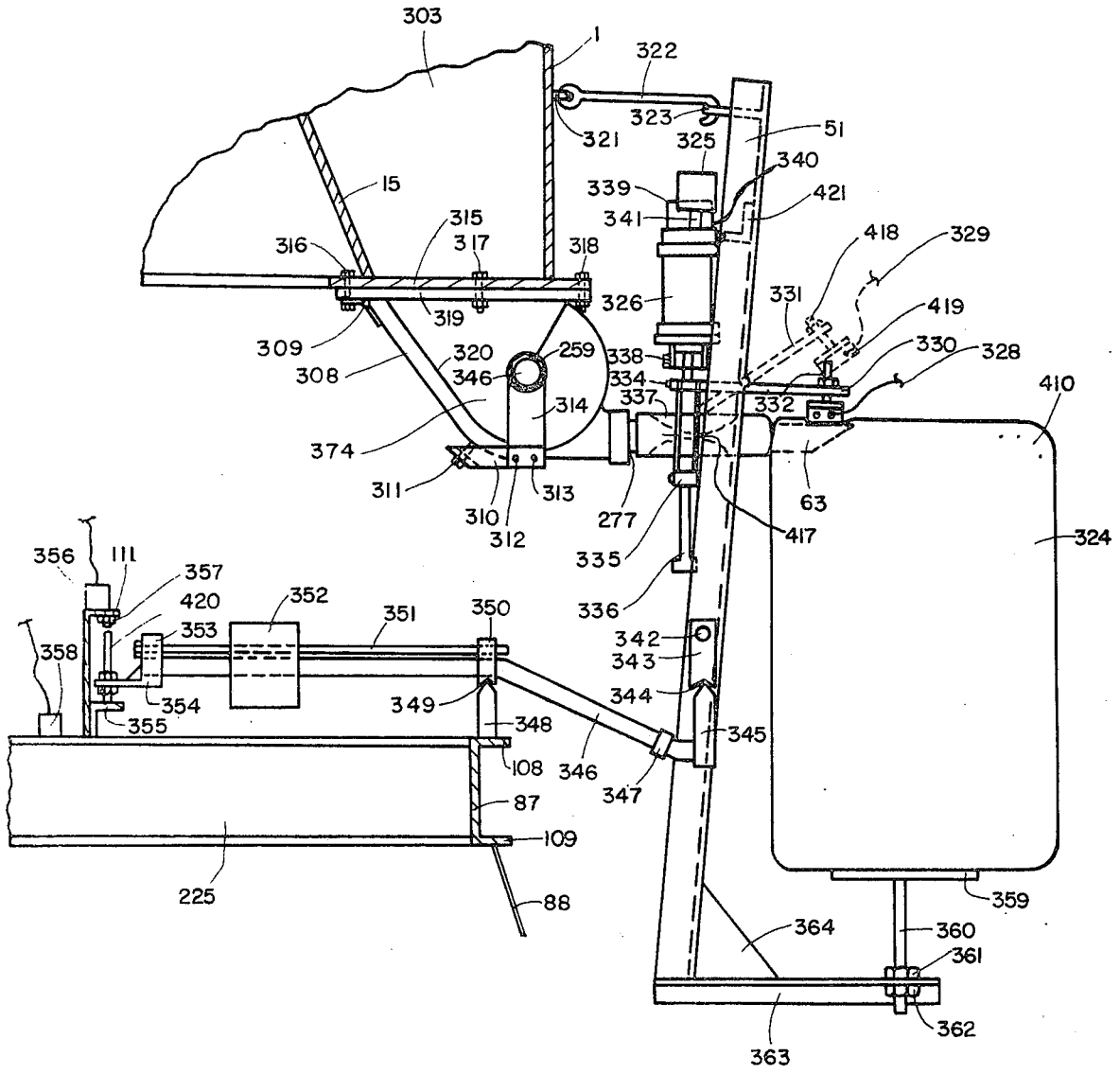
FIG. 11 is a section view showing the clamping mechanisms and balance scale mechanisms associated with impeller housing 274.

Details of various apparatuses in the area of the bag channel supports and spouts are not shown in FIGS. 1 and 2, for purposes of clarity. FIGS. 9, 10, and 11 show these areas in detail, many of these details which would be observable when viewing the bagging machine from the views taken in FIGS. 1 and 2.

Located at the bottom of the bag channel supports are a stool and stool supports. Connected to bag channel support 46 is stool and stool supports 70, connected to bag channel support 47 is stool and stool supports 71, connected to bag channel support 48 is stool and stool supports 72, connected to bag channel support 49 is stool and stool supports 73, connected to bag channel support 50 is stool and stool supports 74, connected to bag channel support 51 is stool and stool supports 75, connected to bag channel support 52 is stool and stool supports 76, connected to bag channel support 53 is stool and stool supports 77, connected to bag channel support 54 is stool and stool supports 78, connected to bag channel support 55 is stool and stool supports 79, connected to bag channel support 56 is stool and stool supports 80 connected to bag channel support 57 is stool and stool supports 81, the apparatus in connection with stool and stool supports 70, 71, 72, 73, 74, 75, 76, 77, 78, 79, 80, and 81 is not shown in detail in FIGS. 1 and 2. Details of the stool and stool supports are shown in FIG. 11.

A rolled tee-bar 113 circles the upper portion of the outer surface 1 of the bagger tank. Welded sprocket chain 112 is welded to rolled tee-bar 113. The drive mechanisms for the bagging machine revolve the bagging machine through the meshing of the welded sprocket chain 112 with sprocket 114, which is driven by speed reducer 115 and electrical motor 116. Speed reducer 115 and electrical motor 116 are mounted on supporting beam 117. The take-off device 2 is driven by electrical motor 116 and speed reducer 115 through take-off device drive sprocket 118 which is physically connected to an output shaft of speed reducer 115 below sprocket 114 and is not shown in FIG. 1 but is detailed in FIG. 13.

Take-off device drive chain 119 is physically attached to take-off device drive sprockets 118 and to shaft driving sprocket 121 which is rigidly connected to the take-off device center shaft 122. Take-off device drive chain 119 is supported on drive chain support track 120. Center shaft 122, shaft driving sprocket 121, and drive chain support track 120 are supported by take-off device shaft support structure 123. Outer shaft 124 fits around center shaft 122. Outer shaft 124 contains slot 125. Key 126 is attached to center shaft 122 and fits within slot 125 which is in outer shaft 124. Key 126 within slot 125 allows outer shaft 124 to rotate in the same manner as the center shaft 122. Slot 125 in outer shaft 124 allows for up and down movement of outer shaft 124 with respect to base 411 and center shaft 122. The various track arms, track arm braces, cradle arm supports, and cradle arm braces and swivel connections and other portions of the take-off device are not numbered in FIG. 1 for the purpose of clarity. These various parts of the take-off device are shown in detail in FIG. 14. The take-off device drops bags into conveyor belt 174 which is on conveyor frame 173.

Figure 4:
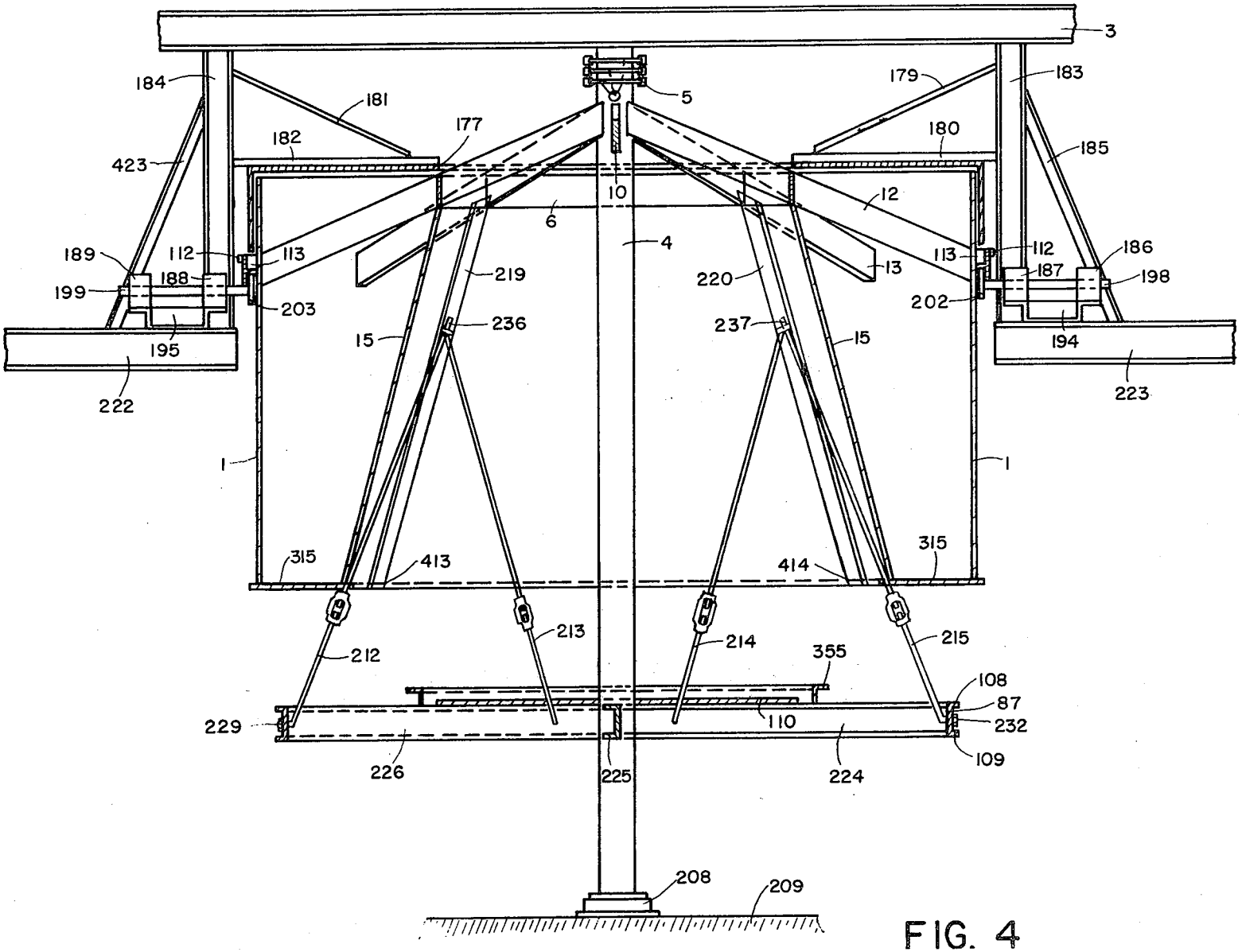
FIG. 4 is a section view of the bagging machine taken at points A—A of FIG. 3.

Below the level of the bottom surface 315 and around the center shaft 4 of the bagger tank lies the machinery platform 110. As shown in FIG. 4, the machinery platform 110 is supported by spoke-like supports 224, 225, 226, and one more not shown which support the machinery platform and the balance scale system which is shown in FIG. 11. Rolled channel beam 87 is a circular beam connected to the ends of spoke-like supports 224, 225, 226, and the spoke-like support not shown. The balance scale mechanism is supported on rolled channel beam 87, as shown in FIG. 11. Balance scale lower end support 355 is a rolled, round shaped angle iron which also rests on spoke-like supports 224, 225, 226, and the support not shown. The rolled channel beam 87 has an upper flange 108 and a lower flange 109.

Figure 5:
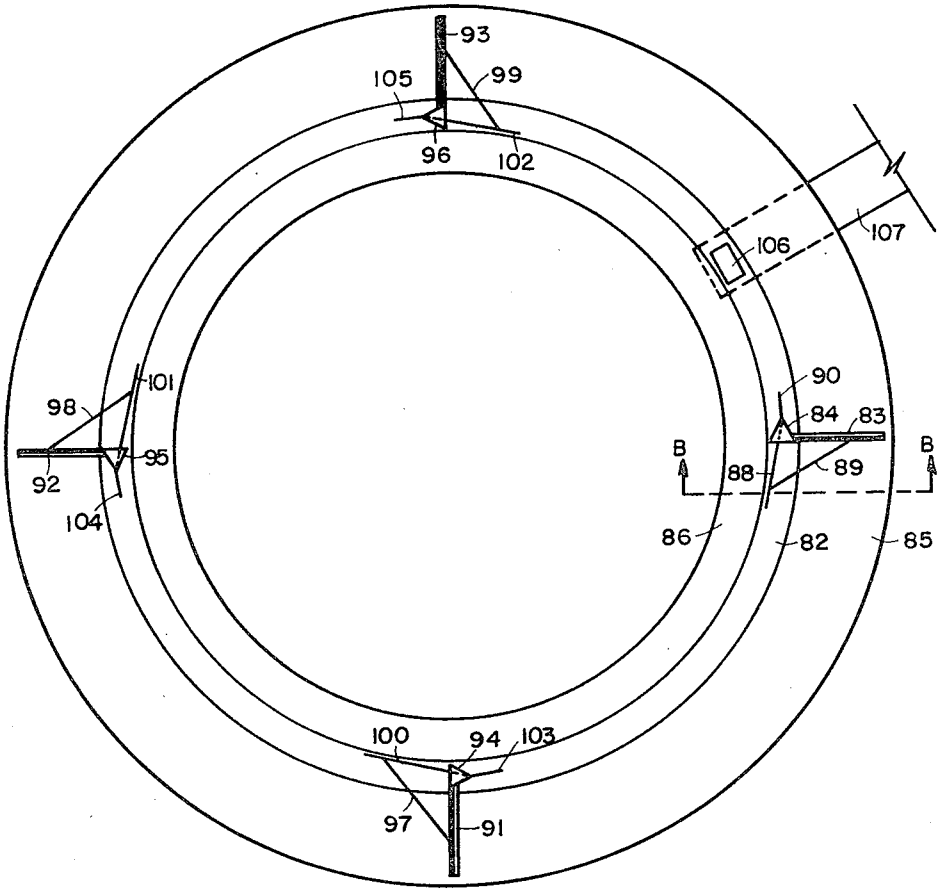
FIG. 5 is a top view taken from a point below the machinery platform of the bagging machine.
Figure 6:
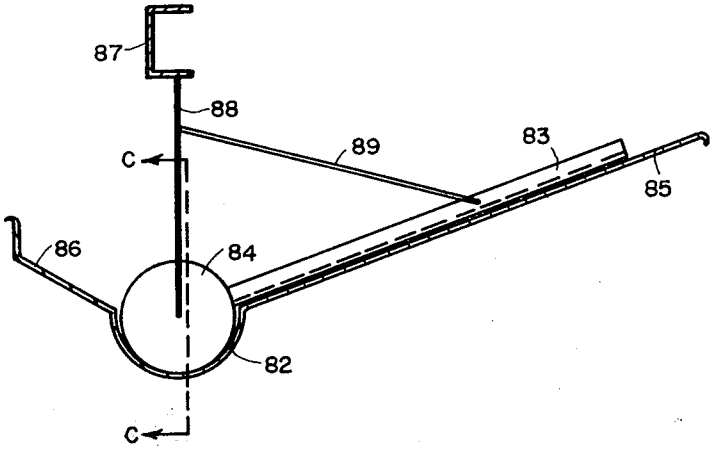
FIG. 6 is a section view taken at points B—B in FIG. 5.
Figure 7:
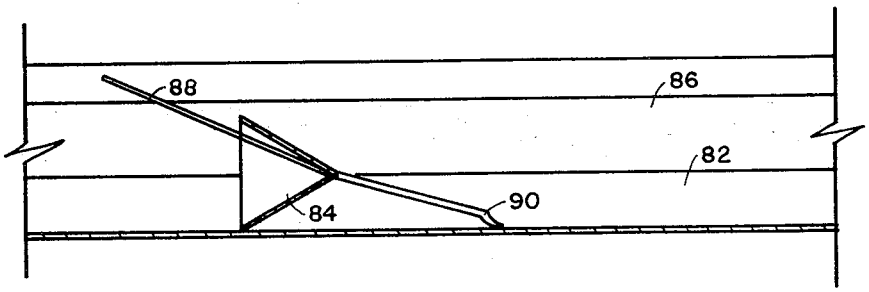
FIG. 7 is a section view taken at points C—C in FIG. 6.

Various parts of the sweep up or spill collection device are shown in FIGS. 1 and 2, including trough 82, sweep arm 83, cone collector 84, outer sloping surface 85, inner sloping surface 86, cone drag chain 88, sweep arm drag chain 89, drag bar 90, sweep arm 93, cone collector 96, sweep arm drag chain 99, and cone drag chain 102 and other portions of the sweep up or spill collection device are shown in detail in FIGS. 5, 6, and 7.

The spill collection device drops the swept up material into spill removal dump hole 106 onto spill removal means 107 which may be a conveyor. The material in spill removal means 107 is then deposited in elevating means 175 which may be a conveyor or elevator to raise the material to the level of feed conveyor 176 where the material is deposited back into a feed conveyor for recycling to the bagging machine. Cover 177 of the bagger tank contains a feeder hole 178. The material is deposited from the conveyor 176 through the feeder hole 178 in cover 177 back into the bagger tank. Cover 177 does not rotate with the bagger tank and is held by cover support members 179, 180, 181, and 182. Cover support members 179 and 180 are attached to support beam 183 which is rigidly attached to upper supporting structure 3. FIG. 2 shows this cover on, but FIG. 1 does not show the cover on so that inner supporting structures may be shown. Supporting structure for cover 177 on the left and the right side is shown in detail in FIG. 4, other additional support structures for cover 177 are contemplated, but are not shown in the drawings. Supporting structure for the bagger tank, including support brace 185, pillow block bearings 186 and 187, angle frame foundation 194, upper foundation support 223, bearing shaft 198, are shown in detail in FIGS. 3 and 4.

Figure 3:
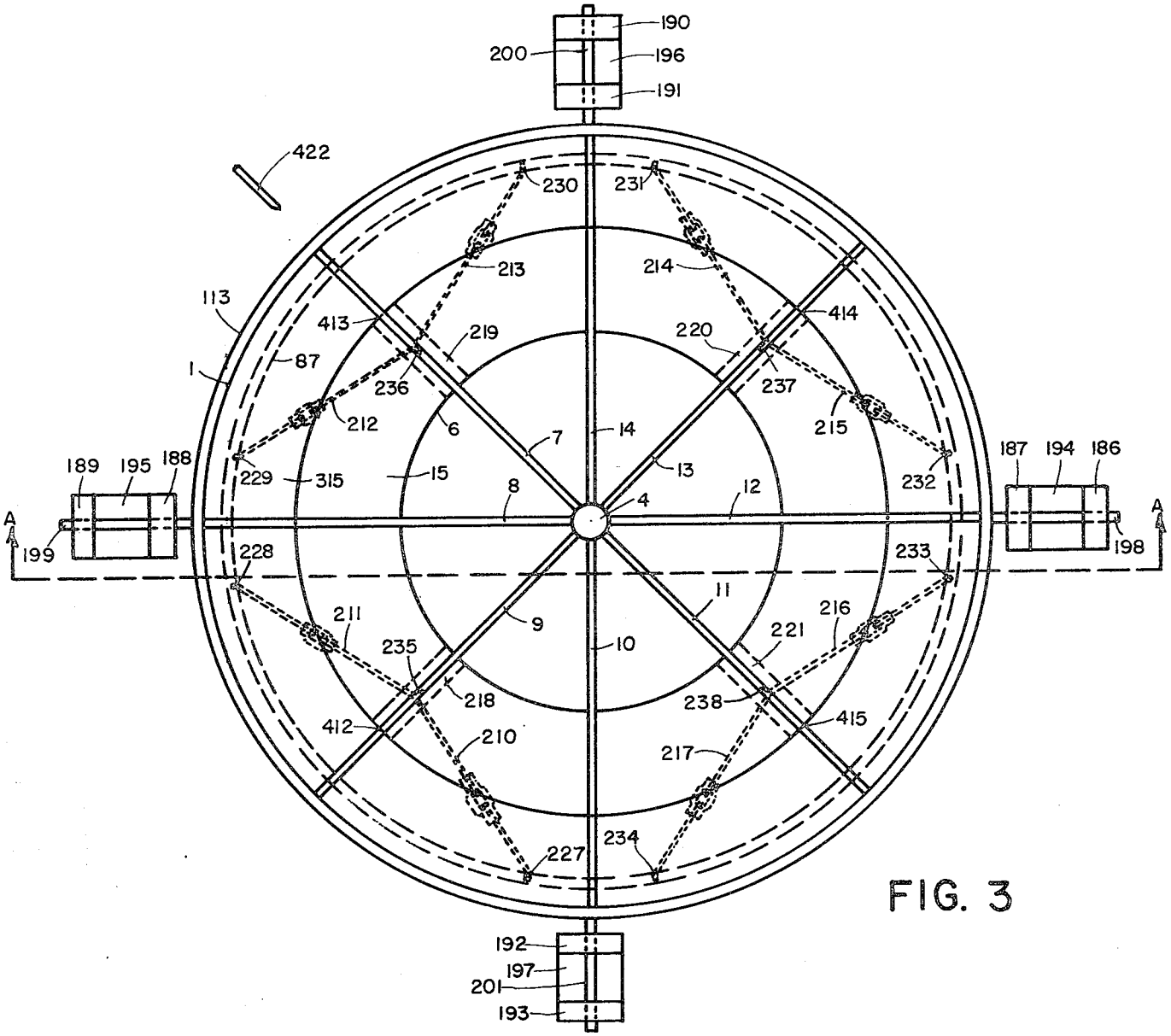
FIG. 3 is a top view of the bagging machine, cut-away to show support members and leveling devices, also showing the position of cam 422 with respect to the bagging machine.

FIG. 3 is a top view of the bagging machine, cut-away to show support members and leveling devices, also showing the position of cam 422 with respect to the bagging machine. FIG. 4 is a section view of the bagging machine taken at points A—A in FIG. 3. The bagging machine has further support and means for leveling the bagging machine, balance scale and machinery platform, including a plurality of turnbucklle tie rods which are connected between structural reinforcing supports and rolled channel beam 87. Turnbuckle tie rod 210 is connected to rolled channel beam 87 by nut anchor 227 and to structural reinforcing support 218 by bolt and nut anchor 235. Turnbuckle tie rod 211 is connected to rolled channel beam 87 by nut anchor 228 and to structural reinforcing support 218 by bolt and nut anchor 235. Turnbuckle tie rod 212 is connected to rolled channel beam 87 by nut anchor 229 and to structural reinforcing support 219 by bolt and nut anchor 236. Turnbuckle tie rod 213 is connected to rolled channel beam 87 by nut anchor 230 and to structural reinforcing support 219 by bolt and nut anchor 236. Turnbuckle tie rod 214 is connected to rolled channel beam 87 by nut anchor 231 and to structural reinforcing support 220 by bolt and nut anchor 237. Turnbuckle tie rod 215 is connected to rolled channel beam 87 by nut anchor 232 and to structural reinforcing support 220 by bolt and nut anchor 237. Turnbuckle tie rod 216 is connected to rolled channel beam 87 by nut anchor 233 and to structural reinforcing support 221 by bolt and nut anchor 238. Turnbuckle tie rod 217 is connected to rolled channel beam 87 by nut anchor 234 and to structural reinforcing support 221 by bolt and nut anchor 238. Structural reinforcing support 218 is rigidly connected between supporting beam 9 and the junction of the sloping interior shell surface 15 of the bagger tank and the bottom surface of the bagger tank which is intersection 412. Structural reinforcing support 219 is connected between supporting beam 7 and the intersection of the sloping interior shell surface 15 of the bagger tank and the bottom surface labeled as intersection 413. Structural reinforcing support 220 is rigidly connected between supporting beam 13 and the intersection of the sloping interior shell surface 15 of the bagger tank and the bottom surface of the bagger tank labeled as intersection 414. Structural reinforcing support 221 is rigidly connected between supporting beam 11 and the intersection of sloping interior shell surface 15 of the bagger tank and the bottom surface 315 of the bagger tank labeled as intersection 415.

FIG. 3 shows the center shaft 4 of the bagging machine. Supporting beams 7, 8, 9, 10, 11, 12, 13, and 14 emanate from the center shaft. Structural reinforcing supports 218, 219, 220, and 221 are connected between various supporting beams and various points at which the sloping interior shell surface 15 of the bagger tank and the inner flange of bottom surface 315 of the bagger tank intersect. Turnbuckle tie rods 210, 211, 212, 213, 214, 215, 216, and 217 are connected between the various structural reinforcing supports 218, 219, 220, and 221 and rolled channel beam 87.

FIG. 4 shows upper supporting structure 3 from which support beams 183 and 184 are attached. Cover support member 179 is connected between support beam 183 and cover 177. Cover 177 is donut shaped and covers the bagger tank. Cover support member 180 is connected to support beam 183 and cover support member 179. The cover 177 is rigidly attached to cover support member 180. Similarly, cover support members 181 and 182 are connected to support beam 184. Cover 177 is rigidly attached to cover support member 182 as well as cover support member 180. Rolled tee-bar 113 is rigidly connected to outer surface 1 of the bagger tank. Welded sprocket chain 112 is welded onto rolled tee-bar 113 and is used to form a ring or bull gear with sprocket 114 as the pinion gear, forming the driving mechanism for the bagging machine.

Upper foundation supports 222 and 223 along with two other supports not shown, form further foundation for the support of the bagging machine. As seen in FIG. 4, resting on upper foundation support 223 is angle frame foundation 194 to which pillow block bearings 186 and 187 are bolted. Bearing shaft 198 runs through pillow block bearings 186 and 187 and is connected to support wheel 202. Rolled tee-bar 113 rests on support wheel 202 and receives support therefrom. Rolled tee-bar 113 also receives support from support wheel 203 along with two other support wheels not shown. Angle frame foundation 195 rests on upper foundation 222. Pillow block bearings 188 and 189 are bolted onto angle frame foundation 195. Bearing shaft 199 runs through pillow block bearings 188 and 189 and connects to support wheel 203. Rolled tee-bar 113 rests on support wheel 203 as well as the other three support wheels previously mentioned, and is supported thereon.

FIG. 3 shows a top view of the four supporting structures which support rolled tee-bar 113, only two of which are shown in FIG. 4. Angle frame foundation 196 rests on an upper foundation support (not shown). Pillow block bearings 190 and 191 are bolted onto angle frame foundation 196. Bearing shaft 200 runs through pillow block bearings 190 and 191 to a support wheel (not shown) which provides additional support for rolled tee-bar 113. Support braces 185 and 423 provide further support for the support beams.

Angle frame foundation 197 rests on an upper foundation support (not shown). Pillow block bearings 192 and 193 are bolted onto the angle frame foundation 197. Bearing shaft 901 goes through pillow block bearings 192 and 193 and connects to a support wheel (not shown) which helps support rolled tee-bar 113.

FIG. 4 shows the base of center shaft 4 of the bagging machine which rests in thrust bearing 208. Thrust bearing 208 rests in foundation support 209. The center shaft 4 of the bagging machine rotates with the entire machine in operation.

FIGS. 5, 6, and 7 show in detail the sweep up or spill collection device of the bagging machine. FIG. 5 is a top view taken from a point below the machinery platform of the bagging machine. FIG. 6 is a section view taken at points B—B in FIG. 5. FIG. 7 is a section view taken at points C—C in FIG. 6. The sweep up or spill collection device comprises four sets of chains, a cone, and a sweep arm. The cones have a drag bar behind for balance so that the cone will stay in an upright position. The cone is dragged around the tank and tends to sweep up any spilled material that is spilled from and around the bags and spouts. The purpose of the sweep up or spill collection device is to return the spilled material back into the bagger tank. Each section that is dragged around the circumference of the bagging machine has a sweep arm, a cone collector, a sweep arm drag chain, a cone drag chain, and a cone drag bar. FIG. 5 shows cone collector 96 with its associated cone drag bar 105, cone drag chain 102, sweep arm 93, and sweep arm drag chain 99. Cone 95 has cone drag bar 104, sweep arm 92, sweep arm drag chain 98, and cone drag chain 101. Cone collector 94 has cone drag chain 100, cone drag bar 103, sweep arm 91, and sweep arm drag chain 97. Cone collector 84 has drag bar 90, sweep arm 83, cone drag chain 88, and sweep arm drag chain 89. Spill removal dump hole 106 and spill removal means 107 are also shown in FIG. 5. The cones or cone collectors are dragged through trough 82 which is rigidly connected to inner sloping surface 86 and outer sloping surface 85. Trough 82, inner sloping surface 86 and outer sloping surface 85 may be made of one piece construction with varying slopes and designs providing only that any material dropped thereon, would tend to settle in trough 82.

The drag chains for the cones are connected to rolled channel beam 87. When the rolled channel beam 87 is rotated along with the bagging machine, the cone is dragged along the trough 82 to pick up excess material in trough 82. The excess material gathered by the cone collectors is dropped into spill removal dump hole 106.

The material then falls upon spill removal means 107 which may be a conveyor and is then conveyed back up into the bagger tank by elevating means 175, feed conveyor 176, and feeder hole 178 in cover 177. There may be more than one spill removal dump hole and more than one spill removal means. They may be placed at different locations wherever convenient under the bagger tank to carry spilled material onto mechanisms that will feed the material back into the bagger tank. Elevating means 175 may be a standard bucket type elevator or any small elevating means which would carry the spilled material back up to the tank where it could be fed onto feed conveyors, such as feed conveyor 176, or other feed mechanisms that feed the main bagger tank in order to recycle the spilled material back into the system. The cone may be just an ordinary sheet metal cone and the chain may be ordinary logging chain. The drag bar maintains the balance of the cone so that the cone will stay in an upright position, being dragged on the outer edge of the cone for maximum efficiency in scouping up material.

In the configuration of this invention shown in the drawings, four sets of cones and supporting apparatus are placed at 90° angles around the spill collection device.

The spill collection device for the revolving machine, which bags material, includes material landing means located below the position in the revolving machine where the material is bagged. The excess material will fall onto the material landing means. Material collection means is operative to collect the material which falls onto the material landing means. Material return means is operative to return the excess material which falls onto the material landing means to the revolving machine.

The material collection means comprises a plurality of collectors, such as cone collectors 96, 95, 94, and 84, and a plurality of collector drag means, such as cone drag chains 102, 101, 100, and 88. The material collection means further comprises a plurality of sweep means, such as sweep arms 92, 93, 91, and 83. The material collection means further comprises a plurality of sweep drag means, such as sweep arm drag chains 89, 97, 98, and 99. The material collection means further comprises a plurality of balance means, each connected to one of the plurality of collectors and operative to maintain proper balance for the plurality of collectors. Cone drag bars 105, 104, 103, and 90 comprise a plurality of balance means.

The plurality of collectors may comprise a plurality of cones. The plurality of collector drag means may comprise a plurality of chains. The plurality of sweep means may comprise a plurality of sweep arms. The plurality of sweep drag means may comprise a plurality of chains. The plurality of balance means may comprise a plurality of drag bars.

The material landing means may comprise a circular trough, such as trough 82, a circular outer sloping surface, such as outer sloping surface 85 connected to the side of trough 82 opposite from the inner sloping surface 86. The plurality of cones is dragged through circular trough 82. The plurality of sweep arms is dragged on surface of circular outer sloping surface 85.

The material return means may comprise a plurality of spill removal holes, a plurality of spill removal means, and a plurality of elevating means. The spill removal holes are located in the material landing means, such as spill removal dump hole 106, located in trough 82. The plurality of spill removal means may be a plurality of conveyors, such as spill removal means 107. The plurality of elevating means which are operative to elevate the excess material and return the excess material to the revolving machine. Other embodiments to perform the means functions may occur to those skilled in the art and are contemplated by this invention.

Figure 8:
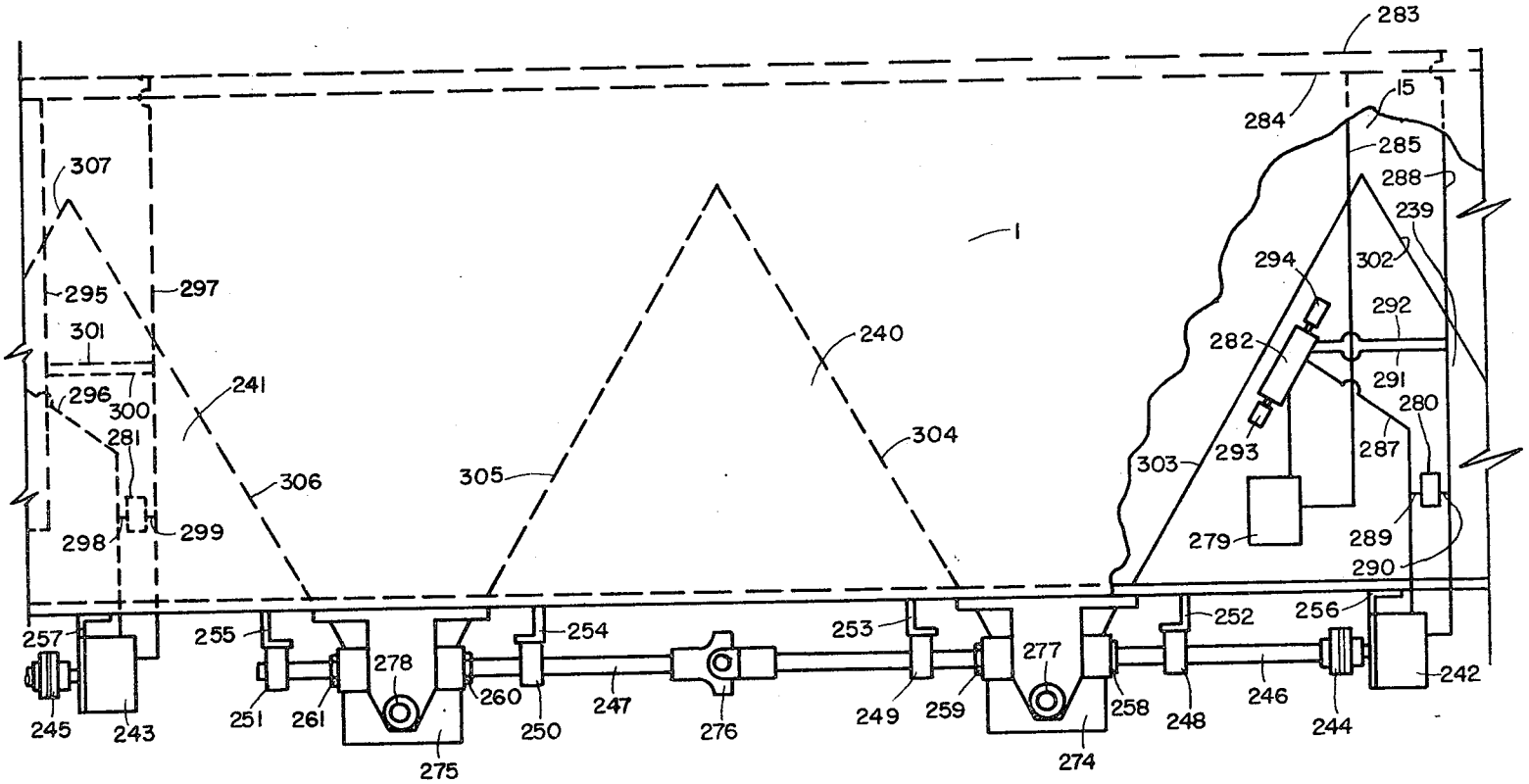
FIG. 8 is a plane front view showing a portion of the bagging machine's impeller housings drive shafts, supporting mechanisms, and impeller hydraulic control mechanisms showing a cut-away view of a void containing the hydraulic control mechanisms.

FIG. 8 is a plane front view showing a portion of the bagging machine's impeller housings and impeller hydraulic control mechanisms showing a cut-away view of a void containing the hydraulic control mechanisms. FIG. 8 shows voids 239, 240, and 241. Void 239 is shown in a cut-away view in order to show the hydraulic control mechanisms that are situated in the void. The hydraulic control mechanisms in void 239 are used with hydraulic motor 242. Every other void on the bagging machine has hydraulic control mechanisms because a hydraulic motor, such as hydraulic motor 242, is only required for every other impeller housing unit. FIG. 8 shows two voids with the hydraulic control mechanisms, void 239 being a cut-away, and void 241 showing portions of the hydraulic mechanisms. Alternate voids not containing the hydraulic control mechanisms, such as void 240, may be used as storage areas for various air and electrical lines used within this invention. Void 239 is formed by sloped guide supports 302 and 303. Void 240 is formed by sloped guide supports 304 and 305. Void 241 is formed by sloped guide supports 306 and 307. These sloped guide supports are formed at an angle so that the fluidized material to be bagged will flow relatively easily and smoothly down the sides of the sloped guide supports into the impeller housings. For example, fluidized material will flow down the sloped guide support 303 and 304 and sloping interior shell surface 15 into impeller housing 274. Material will flow down the sides of sloped guide supports 305 and 306 into impeller housing 275. These guides form a triangular shaped void space furnishing ideal locations for the hydraulic air and electrical control mechanisms.

In void 239, is shown hydraulic line 285 which comes from hydraulic pressure line header 284 and leads to hydraulic flow control valve 279. Hydraulic line 286 leads from hydraulic flow control valve 279 to hydraulic four-way directional control valve 282. Hydraulic four-way directional control valve 282 has start solenoid 293 and stop solenoid 294. Hydraulic lines 291 and 292 lead from hydraulic four-way directional control valve 282 to hydraulic return line 288. Hydraulic return line 288 connects hydraulic motor 242 with hydraulic return line header 283. Pressure relief valve 280 is connected by hydraulic line 289 to hydraulic line 287 and is connected by hydraulic line 290 to hydraulic return line 288.

Void 241 contains a similar hydraulic control mechanism set-up as in void 239, and as would be in every other similar void on the bagging machine. Shown in FIG. 8 is hydraulic line 297 leading from hydraulic motor 243 to hydraulic return line header 283. Hydraulic line 296 leads from a directional control valve (not shown) to hydraulic motor 243. Pressure relief valve 281 is connected by hydraulic line 298 to hydraulic line 296 and by hydraulic line 299 to hydraulic line 297. Hydraulic line 300 leads from a directional control valve (not shown) to hydraulic line 297. Hydraulic line 301 leads from the directional control valve (not shown) to hydraulic line 297. Hydraulic line 295 leads from the hydraulic pressure line header 284 to the flow control valve (not shown). The control valve can be classified as a flow control valve or a speed control valve. The flow control valve may be a Miller fluid power flow control valve ⅜ths of an inch, port size, No. CFGO3-8.OG-E10 or any other comparable valve used in the same manner. This valve is a calibrated vernier scale flow control valve. The purpose of the flow control valve is to control, limit, or adjust the amount of hydraulic fluid going to the hydraulic motors. The valve can control and adjust and therefore vary the speed desired for the motors.

The ability to vary the speed of the impellers by changing the speed of the hydraulic motors over a wide range, permits the use of this bagging machine for bagging materials which vary in consistency and grain size. The machine may, also, be compensated for varying atmospheric conditions which could affect material flow by varying the speed of the impellers.

The hydraulic four-way directional control valves 282 in void 239 may be a Brown and Sharpe four-way double solenoid control valve. It is used as an off and on valve for the hydraulic motor 242. The solenoid may be actuated by cam microswitch 42. The stop solenoid 294 is actuated when the bag weight of the bag being filled by or through spout opening 277 reaches specified limits and the balance scale tips or pivots on the knife-edge of the balance scale mechanism. Microswitch 356 is then actuated which causes the solenoid to shut off hydraulic fluid to the hydraulic motor thereby shutting down or stopping the motor. This process would tend to prevent spillage of material out of the bag and will also prevent material from becoming packed in the spout.

Motors, such as hydraulic motors 242 and 243, turn the impellers in impeller housings 274 and 275. The speed of each motor is controlled by a flow control valve, such as 279, associated with each hydraulic motor. Start and stop control means, such as four-way directional control valves 282 control the hydraulic motors. With motor 242 is associated pressure relief valve 280. The pressure relief valves function to relieve fluid pressure on the rotating motors that are operating to fill bags, when some of the motors are stopped by their respective bags being filled.

On the twenty-four spout machine with twelve hydraulic motors, only six or seven of these motors will be operating at any one time under normal operating conditions. When one motor stops, by action of a stop microswitch, the hydraulic fluid that was required to drive the motor will no longer be needed. Without the motor pressure relief valves 280 and 281, this extra hydraulic fluid and pressure on the hydraulic pressure header would tend to cause the motors, still running, to receive more hydraulic fluid under more pressure, thereby speeding up the motors.

When other motors start up, the reverse situation might occur, with the already running motors tending to slow down. The pressure relief valves work to eliminate these problems.

Hydraulic motor 242 connects into coupling 244 which drives impeller shaft 246. Impeller shaft 246 is supported by pillow block bearing 248. Pillow block bearing 248 is supported by bearing support bracket 252. Hydraulic motor 242 is supported by motor support bracket 256. Impeller shaft 246 leads into impeller housing 274. Impeller housing shaft gland nut 258 seals the impeller shaft 246 within impeller housing 274. Spout opening 277 in impeller housing 274 is the point at which the fluidized material comes into the bag. Impeller shaft 246 goes through impeller housing 274 and comes out of the other side. Impeller housing shaft gland nut 259 seals the impeller shaft on the other side of impeller housing 274. Impeller housing shaft gland nuts 258 and 259 keep material from flowing out around impeller shaft 246 as the shaft is rotated. Impeller shaft 246 is then supported by pillow block bearing 249. Pillow block bearing 249 is supported by bearing support bracket 253. Impeller shaft 246 then leads into universal joint 276. From universal joint 276, impeller shaft 247 leads into impeller housing 275. Impeller shaft 247 is supported by pillow block bearing 250 and bearing support bracket 254. Impeller housing shaft gland nut 260 seals impeller shaft 247 within impeller housing 275. Impeller shaft 247 goes through impeller housing 275 and impeller housing shaft gland nut 261 seals impeller shaft 247 on the other side of impeller housing 275. At that point, the impeller shaft 247 is supported by pillow block bearing 251. Pillow block bearing 251 is supported by bearing support bracket 255. Hydraulic motor 243 is shown under void 241, and is supported by motor support bracket 257. Coupling 245 is shown connected to hydraulic motor 243. Each hydraulic motor, such as 242 and 243, will drive impellers in two bagger housings by use of a universal joint, for example, hydraulic motor 242 drives the impellers in impeller housings 274 and 275. Hydraulic motor 243 would drive the impellers in two bagger housings which are not shown. If the bagging machine has 24 spouts, then twelve motors will be required. Other similar bagging machines with different numbered spouts would require differing numbers of motors. One factor which needs to be evaluated upon considering the quantity of motors required would be the degree of bend for the shaft in the universal joint.

FIG. 9 is an elevation view taken from the side of impeller housing 274, further showing the associated bag clamping mechanisms. FIG. 10 is a section view taken at points 10—10 in FIG. 9 which is from the rear of impeller housing 274, showing the interior of impeller housing 274.

FIG. 9 shows sloped guide support or surface 303. Impeller housing 274 is attached to the bottom surface 315 of the bagger tank. Impeller housing or enclosure 274 is attached to bottom surface 315 by mounting bolts, such as mounting bolts 316, 317, and 318. Only three mounting bolts are shown in FIG. 9 although eight actually exists for each impeller housing. Mounting bolts 316, 317 and 318 are placed through molded top 319 of impeller housing 274 and through bottom surface 315 to attach impeller housing 274 to bottom surface 315. Impeller housing 274 has access door 308 which is connected to molded top 319 by hinge 309. Bracket 310 holds access door 308 in a closed position and is secured by opening bolt 311. Mounting bolts 312 and 313 hold bracket 310 onto impeller housing 274 by attaching bracket 310 to impeller housing support 314 which is in a fixed position on impeller housing 274. FIG. 9 shows impeller shaft 246 and impeller housing shaft gland nut 259. Gasket 320 seals access door 308 and impeller housing 274 to prevent any material from escaping through the crack or joint around access door 308. Access door 308 is a molded door which is hinged by use of hinge 309 to allow easy opening. Removal of one bolt, opening bolt 311 allows the hinged access door 308 to open for easy access into the impeller housing for removal or replacement of the impeller blades or for other maintenance. Impeller housing support 314 can be molded along with the access door and impeller housing.

Impeller housing shaft gland nut 259 and 258 are shown in FIG. 10, the impeller housing shaft gland nut 258 is cut-away to show cut-away sides 264 and 265. Impeller housing shaft gland nut 259 is cut-away to show cut-away sides 262 and 263. Impeller housing shaft gland nut 258 and its cut-away sides 264 and 265 hold packing material 267 in impeller housing 274, and prevent the material being bagged from spilling out or flowing out around the shaft. Impeller housing shaft gland nut 259 and its cut-away sides 262 and 263 hold packing material 266 in impeller housing 274. Packing material 266 and 267 may be wool or fiber packing which fits on the inside of the gland nuts and prevents the material being bagged from spilling out or flowing out around the shaft. This packing material can be packed and re-packed by loosening the gland nut.

FIG. 10 shows an impeller blade within impeller housing 274. In the cut-away of the impeller, replaceable impeller blade tips 268 and 269 are shown. Replaceable impeller blade tip 268 is connected to impeller blade tip holder 270 by impeller blade tip mounting bolt 272. Replaceable impeller blade tip 269 is attached to impeller blade tip holder 271 and held by impeller blade tip mounting bolt 273. The impeller is held on by bolts not shown in FIG. 10. The impeller fits around the shaft at the center of impeller housing 274. The impeller turns with the shaft in a counter clockwise direction, as viewed in FIGS. 9 and 11, and throws the material to be bagged out through the spout opening 277. The material goes out spout opening 277 and through spout hose 337, out spout 63, and into bag 324. The impeller may be any standard paddle wheel type impeller which would fit upon a turning shaft and perform the function of moving or impelling material to be bagged through the impeller housing and out the spout opening. FIG. 10 also shows the molded top 319 of the impeller housing 274 and coupling 244 along with impeller shaft 246. The coupling, such as coupling 244, may consist of any standard shaft coupling device.

Replaceable blade tips 268 and 269 can be replaced by removing impeller blade tip mounting bolts 272 and 273 and removing the blade tips 268 and 269 from the impeller blade tip holders 270 and 271. New replaceable impeller blade tips can be, then, inserted into the blade tip holders and mounted by use of the blade tip bolts 272 and 273. The number of impeller tips and impeller design can be any standard impeller and can be left to the manufacturer's choice of design. U-bracket 321 is attached to the outer surface of the bagger tank 1. Attached to U-bracket 321 is scale support channel hook 322 which attaches the channel U-bracket 323 to bag channel support 51.

The housing for the impeller, which is mounted on the impeller shaft and is capable of moving material, basically comprises an enclosure, such as impeller housing 274, within which the impeller, mounted on impeller shaft 246, may be placed. The enclosure has a plurality of shaft openings through which the impeller shaft 246 may extend. A plurality of shaft opening packing means or gland nuts 259 and 258 are secured to the enclosure at each of the plurality of shaft openings. A plurality of packing material, such as wool or fiber packing, is placed within each of the plurality of shaft opening packing means and around the impeller shaft.

Molded top 319 of impeller housing 274 has an opening through which material may be placed in the enclosure or impeller housing 274. The molded top with the opening comprises material entrance means. Material exit means comprises spout opening 277 through which material may exit from the housing.

Access means in the enclosure allows access for maintenance purposes within the enclosure. Access means comprises access door 308, attachment means connecting the access door 308 to the enclosure and securing means holding the access door onto the enclosure. The attachment means comprises a hinge which connects the access door 308 to the enclosure or impeller housing 274. The securing means comprises bracket 310 and securing bolt or opening bolt 311. The access means further comprises sealing means to keep any of the material from escaping through the access door. The sealing means comprises gasket 320. The securing means further comprises an impeller housing support 314 molded onto the enclosure and a plurality of mounting bolts, such as mounting bolts 312 and 313 to secure the bracket 310 to the impeller housing support 314. Other embodiments to perform the means functions may occur to those skilled in the art and are contemplated by this invention.

FIG. 11 is a section view showing the clamping mechanisms and balance scale mechanisms associated with impeller housing 274. FIG. 11 may be examined along with FIGS. 9 and 10 for a more complete view. Air cylinder control pilot valve 325 controls air cylinder 326. Cylinder opening air pilot line 339 and cylinder closing air pilot line 340 along with connecting base 341 are shown between the air cylinder control valve 325 and air cylinder 326. Chopper or pinch valve linkage connection bolt 338 holds air cylinder 326 to top chopper valve linkage bar 334. Also, shown is bottom chopper or pinch valve linkage bar 335 and spring 336.

The clamping mechanism lever rod is shown in a clamped position, as rod 330 and in an unclamped position, as clamping mechanism lever rod 331. The clamping mechanism lever rod 330 pivots about the pivot pin 333. One end of the clamping mechanism lever rod supports and has attached to it the clamping mechanism, clamping mechanism apparatus 327. Apparatus 327 is attached by means of adjusting bolt 418 and adjusting bolt 332. Clamping mechanism lever rod 330 is also attached to chopper or pinch valve linkage bar 334. When chopper valve linkage bars 334 and 334 operate from the unclamped to the clamped position on spout hose or material flow hose 337, the clamping mechanism lever rod also moves because of the direct connection. Air cylinder 326 is supported rigidly to bag channel support 51 by means of air cylinder support bracket 421.

In the unclamped position, adjusting bolt 418 is shown for clamping mechanism apparatus 419. The clamping mechanism apparatus may consist of a bolt and a pad or other attaching means or devices. In the bottom of the clamping mechanism apparatus 327 is shown electrical contact 328. The electrical contact 329 is shown at the bottom of clamping mechanism apparatus 419. Electrical contacts and wires 328 and 329 serve the purpose of making electrical contact with spout 63, so that if no bag is present on the spout 63, an electrical contact is therefore made with spout 63.

With the electrical connection to spout 63 completing the electric circuit, this electrical signal actuates the air solenoid valve 358 which immediately causes the air chopper valve, consisting of 325, 339, 341, 340, 326, 338, 334, 335, and 336, to operate to pinch the spout hose 337, thus preventing any material from flowing out of spout opening 277 and spout 63, thereby preventing material to be sprayed out of spout 63 when no bag, such as bag 324, is inserted on spout 63. When a bag such as bag 324 is inserted on spout 63, the bag serves as insulation preventing the completion of the electrical circuit between spout 63 and electrical contacts 328 and 329. The electrical contact made when no bag is present activates air control solenoid valve 358 which shifts four-way control valve 325 to force the air chopper valve to the pinching position.

In the operation of the revolving bagging machine, a bag may be inserted on spout 63 by some bag inserting means, including mechanical or human means. Air start valve 33 contacts a rigid stationary cam 422, located and positioned approximately 8 feet past the take-off device and at a height required for contact with support 21, which supports air start valve 33 and hydraulic start microswitch 42. The contact of the air start valve 33 with the rigid stationary cam 422 activates the air control four-way valve 325, shifting its control mechanism to retract the air cylinder 326 of the chopper valve to a position where the chopper valve is not pinching spout or material flow hose 337. This action of air cylinder 326 through the chopper valve clamping mechanism linkage connections 416 and 417 separates chopper linkage bars 334 and 335, thus relieving all pressure on spout or material flow hose 337. Spout or material flow hose 337 then may assume a natural round shape with a round hollow center opening through which material to be bagged may be impelled by the centrifugal force caused by the rotating impeller in the impeller housing 274.

The rigid stationary cam 422, also, contacts the operating lever arm actuator of hydraulic start microswitch 42, causing completion of an electrical circuit from microswitch 42 to the hydraulic four-way control valve start solenoid 293. The completion of the electrical circuit actuates solenoid 293 causing the operating mechanisms of the hydraulic four-way control valve 282 to shift, permitting flow of hydraulic fluid to hydraulic motor 242. The flow of hydraulic fluid to the hydraulic motor 242 causes the shaft of motor 242 to rotate, thereby rotating shaft 246 through connection by coupling 244.

In FIGS. 1 and 2, it may be noticed that on each support 16, 17, 18, 19, 20, 21, 22, 23, 24, 25, 26, and 27, there is an air start valve 28, 29, 30, 31, 32, 33, 34, 35, 36, 37, 38, and 39. However, there is a start microswitch 40, 41, 42, 43, 44, and 45, on every other support 16, 17, 18, 19, 20, 21, 22, 23, 24, 25, 26, and 27. The air start valves are necessary to operate the pinch valves which open up each spout, and therefore, one is required for each spout. The start microswitches activate the hydraulic motors and there is only one hydraulic motor for each two spouts since one hydraulic motor drives two spouts through the use of a universal joint, such as 276. As the bagging machine rotates, the hydraulic motor turns the impeller shaft, the material to be bagged is forced out through the spouts, and the bags are filled. The turning of the impeller pushes the material into the bag along with air that is pushed into the bag, the bag has air bleed holes 410 which allow the air to bleed out of the bag slowly. When the bag has reached a pre-determined weight, the balance scale system is pivoted on knife-edges, such as 348, 349, and 350, by the weight of the bagged material, over balancing a pre-determined weight on counter weights, such as counter weight 352. The balance scale system then makes contact with scale balance support arm contact 420 which may activate a stop air valve on each balance scale and a stop microswitch on alternate balance scales. The stop microswitch stops the hydraulic motor, and the stop air valve causes the pinch valve to pinch the spout hose and stop the flow of material into the bag.

In FIG. 11, bag 324 sits on stool 359. Adjusting stool support 360 holds stool 359 and adjusts the height of stool 359, adjusting stool support 360 being secured by height adjusting nuts 361 and 372. Stool support arm 363 and brace 364 form a support for adjusting stool support 360. Stool support arm 363 and brace 364 attach to bag channel support 51. Attached to bag channel support 51 is balance scale knife-edge channel bracket 343 which is supported by support shaft 342 for knife-edge channel bracket 343. Fitting into knife-edge channel bracket 343 is knife-edge point 344 of lower knife-edge bracket 345 which is attached to balance scale support arm 346. Balance scale support arm brace 347 ties support arm 346 to a similar support arm on the other side of support arm 346. A similar arrangement exists on the other side of the bag channel support 51 with support shaft 342, extending through bag channel support 51, for knife-edge channel bracket, a knife-edge, and a lower knife-edge bracket along with a balance scale support arm. All are identical to 342, 343, 344, 345, 346, and 347. Balance scale support arm 346 and the balance scale support arm (not shown) connect to balance scale platform upper knife-edge bracket 350 in which fits balance scale platform lower knife-edge bracket 348. Balance scale platform lower knife-edge bracket 348 rests on upper flange 108 of rolled channel beam 87. Also, shown is lower flange 109 of rolled channel beam 87 and the cone drag chain 88 attached thereto. Balance scale platform lower knife-edge bracket 348, resting on upper flange 108 of rolled channel beam 87, would be in a similar location for every balance scale as in FIG. 11. The balance scale mechanism shown happens to concur with the positioning of spoke-like support 225. There is a balance scale mechanism for each spout and the balance scale mechanism does not lie above a spoke-like support in every case.

Balance scale counter weight 352 is adjusted for lever arm length from knife-edge 349 by balance scale counter weight adjusting screw 351. Counter weight 352 slides on an extension of balance scale support arm 346. Balance scale support arm end bracket 353 supports the end of balance scale counter weight adjusting screw 351 and balance scale support arm 346 and one balance scale support arm not shown, similar to balance scale support arm 346. When the bag 324 reaches a pre-determined weight, the balance scale system is tipped or pivoted by the weight of the bag causing the balance scale support arm 346 end to rise and for balance support arm contact 420 to hit or activate the lever arm of stop microswitch 356 and stop air valve 357. Alternately, the balance scales will have a stop microswitch to stop the hydraulic motor. Each of the balance scales will have a stop air valve to cause the pinch valve to pinch the spout or material flow hose and stop the flow of material into the bag.

When the bag 324 reaches the pre-determined weight, it presses down causing the knife-edge channel bracket 343 to press onto the knife-edge point 344 and causing the knife-edge channel bracket on the other side of bag channel support 51 which is not shown, to press down on the knife-edge not shown. This causes balance scale upper knife-edge bracket 350 to pivot on balance scale platform knife-edge 349 causing the balance scale support arm 346 to rise causing balance support arm contact 420 to make contact with stop air valve activator 357 and stop microswitch activator 356.

The balance scale mechanism is essentially a fulcrum or scale beam balance system which may be adjusted for differing weights of bagged material by varying the distance from knife-edge 349 to counter weight 352 by the balance scale counter weight adjusting screw 351 of balance scale counter weight 352. When the desired weight is reached, the balance scale moves causing contact with switches that turn off the hydraulic motors and close the pinch valve and spout or material flow hose to the spout, thereby de-activating that spout apparatus.

Figure 12:
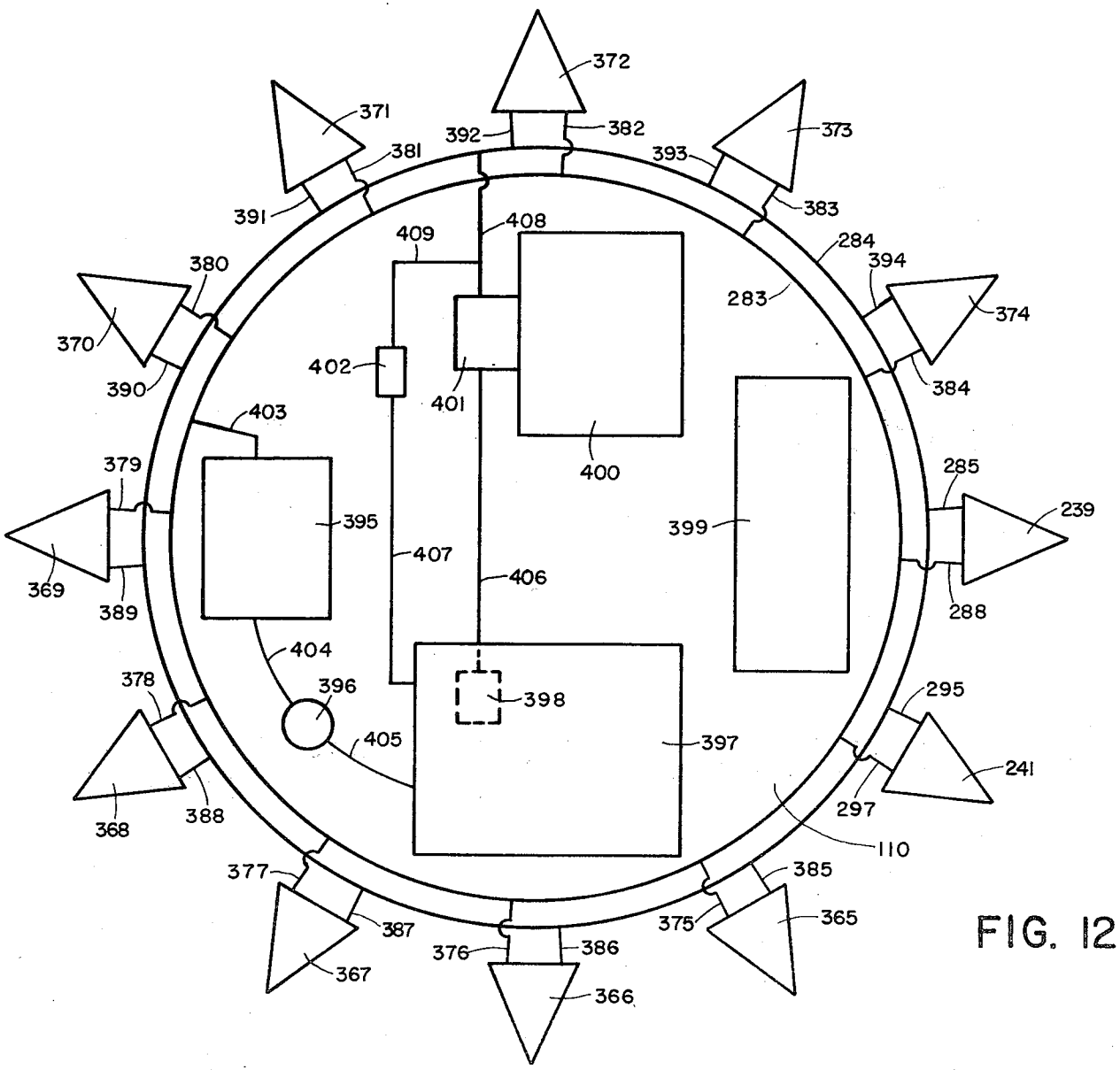
FIG. 12 is a top view of the machinery platform 110 showing the hydraulic system and air compressor thereon, in a black box format, further showing twelve triangular voids.

FIG. 12 is a top view of the machinery platform 110 showing the hydraulic system thereon in a black box format. FIG. 12 shows triangular shaped voids from which hydraulic lines to hydraulic pressure line header 384, and hydraulic return line header 283 connect. There are a total of 24 voids around the bagging machine; however, as previously discussed, hydraulic lines are only required in every other void in order to activate the 12 hydraulic motors required to drive the 24 impeller shafts. Void 239 connects to hydraulic pressure line header 284 by hydraulic line 285 and to hydraulic return line header 283 by hydraulic line 288. Void 241 connects to hydraulic pressure line header 284 by hydraulic line 295 and to hydraulic return line header 283 by hydraulic line 297. Void 365 is connected to hydraulic pressure line header 284 by hydraulic line 385 and to hydraulic return line header 283 by hydraulic line 375. Void 366 is connected to hydraulic pressure line header 284 by hydraulic line 386 and to hydraulic return line header 283 by hydraulic line 376. Void 367 is connected to hydraulic pressure line header 284 by hydraulic line 387 and to hydraulic return line header 283 by hydraulic line 377. Void 368 is connected to hydraulic pressure line header 284 by hydraulic line 388 and to hydraulic return line header 283 by hydraulic line 378. Void 369 is connected to hydraulic pressure line header 284 by hydraulic line 389 and to hydraulic return line header 283 by hydraulic line 379. Void 370 is connected to hydraulic pressure line header 284 by hydraulic line 390 and to hydraulic return line header 283 by hydraulic line 380. Void 371 is connected to hydraulic pressure line header 284 by hydraulic line 391 and to hydraulic return line header 283 by hydraulic line 381. Void 372 is connected to hydraulic pressure line header 284 by hydraulic line 392 and to hydraulic return line header 283 by hydraulic line 382. Void 373 is connected to hydraulic pressure line header 284 by hydraulic line 393 and to hydraulic return line header 283 by hydraulic line 383. Void 374 is connected to hydraulic pressure line header 284 by hydraulic line 394 and to hydraulic return line header 283 by hydraulic line 384. Hydraulic line 403 connected hydraulic return line header 283 to heat exchanger 395 where the hydraulic fluid is cooled. Hydraulic line 404 connects the heat exchanger 395 to the return line filter 396 where the oil is filtered. Hydraulic line 405 connects the return line filter 396 to the hydraulic oil reservoir 397. The oil comes out of the reservoir into a suction strainer 398 and is carried through hydraulic line 406 to hydraulic pump 401. Hydraulic pump 401 is controlled by hydraulic pump electrical motor 400. Hydraulic pump 401 is connected to the hydraulic pressure line header 284 by hydraulic line 408. Hydraulic line 408 also connects to hydraulic line 409 which leads to the main pressure relief valve 402. Hydraulic line 407 leads from main pressure relief valve 402 back into hydraulic oil reservoir 397. Air compressor and tank 399 is shown on the machinery platform 110. Air is available therefrom for operation of all pinch valve air cylinders and other purposes desired, such as tank vibrators, material agitation air pads, and similar devices.

Figure 13:
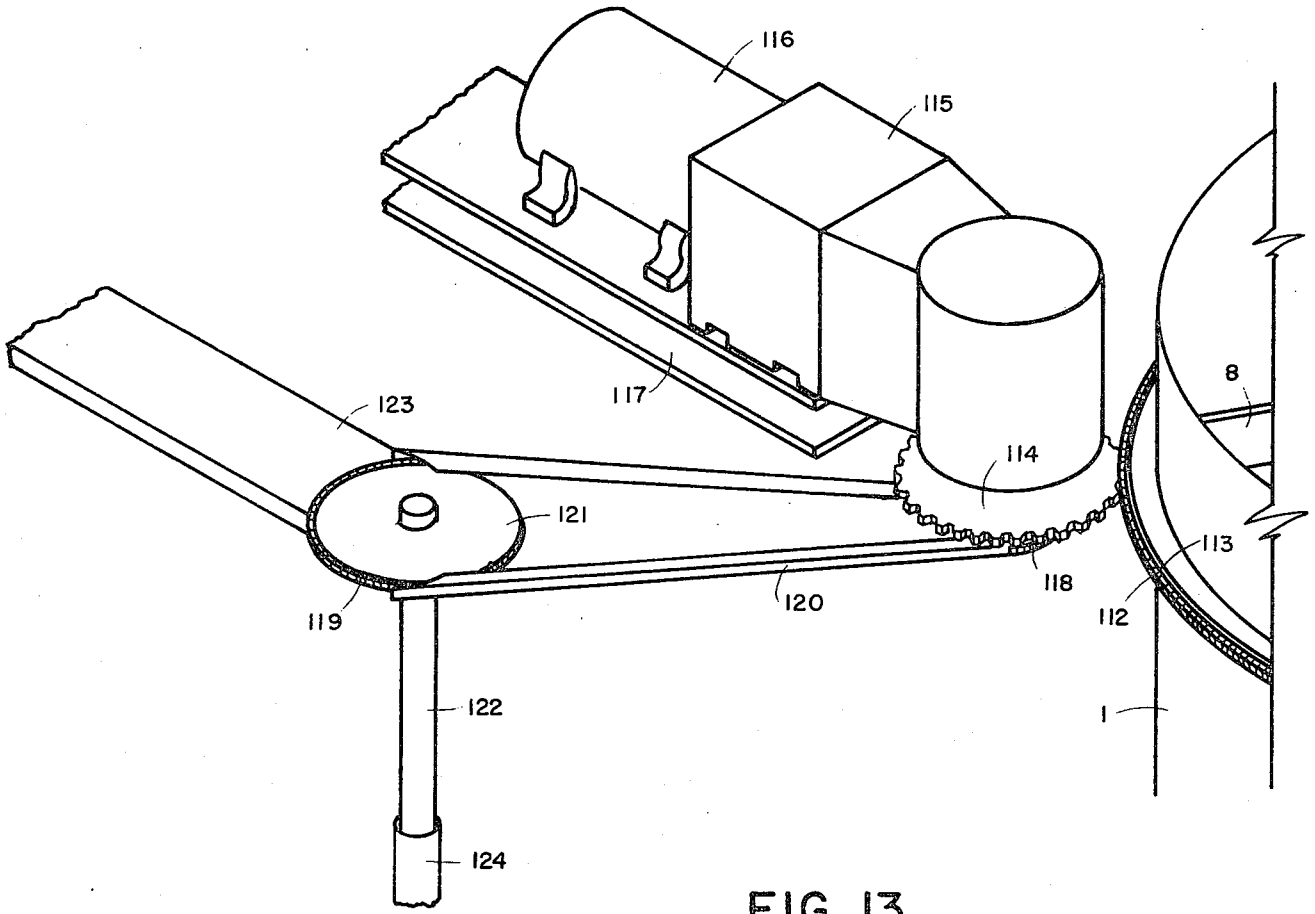
FIG. 13 is an isometric view of the bagging machine drive mechanism and the take-off device drive mechanism.

FIG. 13 is an isometric view of the bagging machine drive mechanism and the take-off device drive mechanism. Welded sprocket chain 112 is welded onto rolled tee-bar 113. Sprocket 114 drives machine driving means, such as welded sprocket chain 112 which by its connection to rolled tee-bar 113 form a ring or bull gear, being the main driving force for the bagging machine. Take-off device drive sprocket 118 drives take-off device drive chain 119 which is supported on drive chain support track 120. Take-off device drive chain 119 connects to shaft driving sprocket 121 which is rigidly connected to center shaft 122 of the take-off machine. Center shaft 122 and shaft driving sprocket 121 are supported by take-off device shaft support structure 123. Speed reducer 115 and electrical motor 116 are supported by supporting beam 117. The speed reducer 115 which drives the bagging machine causing it to rotate, and also drives the take-off device, could be a standard speed reducer, such as a Falk Manufacturing Company type FZB, class 2, size 51–60 FZB 4. It has an output low speed shaft of 13.6 rpms. The speed reducer may have an output or low speed shaft drive sprocket 114 which is a Dodge Manufacturing Corporation No. B1232 one and one-half inch circular pitch sprocket with a suitable bore. This would be sprocket 114 which meshes with welded sprocket chain 112 to cause the bagging machine to rotate. The speed reducer or low speed shaft also has a second sprocket located just beneath it which is a smaller sprocket 118. This may be a Dodge Manufacturing Corporation sprocket No. B642 three-fourths inch circular pitch sprocket with a suitable bore. This sprocket drives the take-off device. The take-off device is driven through a No. 60 three-fourths inch pitch sprocket chain which may be a Dodge Manufacturing Corporation chain or equal standard sprocket chain, which is take-off device drive chain 119. The driven sprocket for this take-off device, shaft driving sprocket 121, may be a Dodge Manufacturing Corporation No. A684 three-fourths inch circular pitch sprocket with a C40-4040 Bushing with bore to suit. The arrangement of chains and sprockets is synchronized so as to turn the take-off device six revolutions for every one revolution of the bagging machine. The speeds are synchronized through the sprocket chains. The main bagging machine may be driven at a set speed in a circular motion caused to rotate while the take-off device is also driven by the same speed reducer 115. The take-off device takes six complete revolutions for each one revolution of the main bagging machine. Therefore, on a twenty-four spout bagging machine, four spouts of the bagging machine pass the take-off device for one complete revolution of the take-off device.

Drive chain support track 120 becomes necessary since the sprocket chain, take-off device drive chain 119, is in a horizontal plane in operation. Drive chain support track 120 helps keep take-off device drive chain 119 from running off the sprocket 121 and 118.

Figure 14:
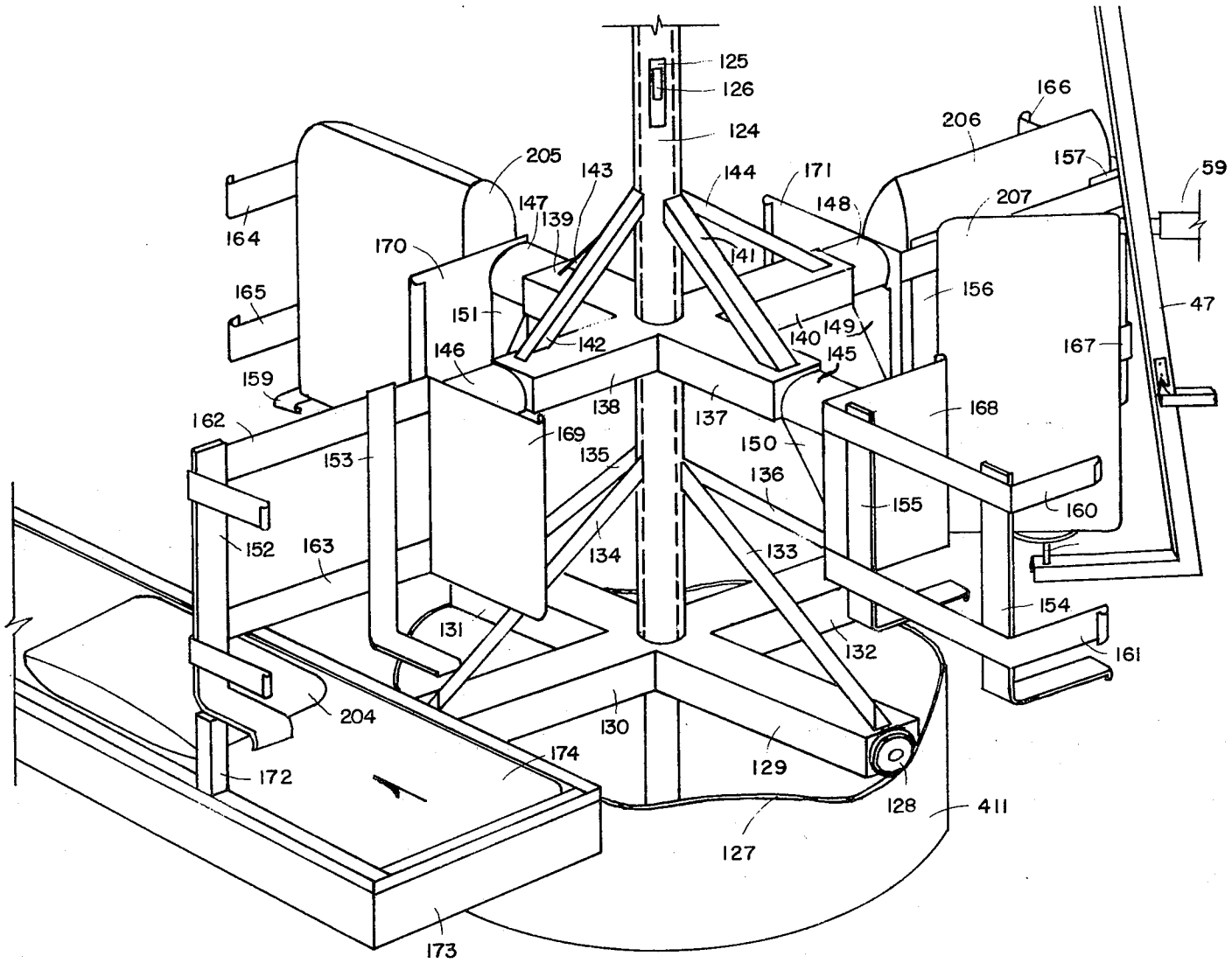
FIG. 14 is an isometric view of the lower section of the take-off device.

FIG. 14 is an isometric view of the lower section of the take-off device. The lower section of the take-off device and many other parts of the bagging machine and associated devices were shown in FIG. 1. FIG. 14 shows the take-off device in greater detail. Outer shaft 124 fits around center shaft 122. Outer shaft 124 contains slot 125. Key 126 is attached to center shaft 122 and fits within slot 125 which is in outer shaft 124. Key 126 within slot 125 causes outer shaft 124 to rotate in the same manner as center shaft 122. Slot 125 in outer shaft 124 allows for up and down movement of outer shaft 124 with respect to base 411. On base 411 is guiding track 127. Connected to outer shaft 124 are cradle arm supports 137, 138, 139, and 140 and track arms 129, 130, 131, and 132. At the end of track arm 129 is flanged wheel 128. A wheel is on the end of track arms 130, 131, and 132; however, they are not shown in FIG. 14. Flanged wheel 128 and the three wheels not shown ride on track 127. Track arm brace 133 braces track arm 129 to outer shaft 124. Track arm brace 134 braces track arm 130 to outer shaft 124. Track arm brace 135 braces track arm 131 to outer shaft 124. Track arm brace 136 braces track arm 132 to outer shaft 124. Cradle arm brace 141 braces cradle arm support 137 to outer shaft 124. Cradle arm brace 142 braces cradle arm support 138 to outer shaft 124. Cradle arm brace 143 braces cradle arm support 139 to outer shaft 124. Cradle arm brace 144 braces cradle arm support 140 to outer shaft 124. Swivel connection 145 connects cradle arm support 137 to cradle support side 168. Swivel connection 146 connects cradle arm support 138 to cradle support side 169. Swivel connection 147 connects cradle arm support 139 to cradle support side 170. Swivel connection 148 connects cradle arm support 140 to cradle support side 171. Back and side arms 160 and 161 are connected to cradle support side 168. Cradle lifters 154 and 155 are connected to back and side arms 160 and 161. Back and side arms 162 and 163 are connected to cradle support side 169. Cradle lifters 152 and 153 are connected to back and side arms 162 and 163. Back and side arms 164 and 165 are connected to cradle support side 170. Cradle lifters 159 and one not shown are connected to back and side arms 164 and 165. Back and side arms 166 and 167 are connected to cradle support side 171. Cradle lifters 156 and 157 are connected to back and side arms 166 and 167. Rigid support 149 connects swivel connection 148 to cradle support side 171. Rigid support 150 connects swivel connection 145 to cradle support side 168. Rigid support 151 connects swivel connection 147 to cradle support side 170. A rigid support (not shown) connects swivel connection 146 to cradle support side 169. The take-off device has in essence four cradles consisting of the various cradle support sides, back and side arms, and cradle lifters. The take-off device in FIG. 14 is shown as it would be in operation. The take-off device rides on guiding track 127 with wheels, such as wheel 128 on the guiding track 127. The guiding track 127 is designed so that the take-off device rides in an up and down motion. At the low point, the cradle rides below the bag as it sits on the stool. In FIG. 14, stool and stool supports 71 are shown holding bar 207. Cradle lifters 154 and 155 will ride at a position where as the take-off device is rotated it will rise underneath the bag and take bag 207 from stool and stool support 71, and from spout 59 at the peak of its sinusoidal path. The cradle arms will then hold the bag and carry it around the take-off device, such as bag 205 is being carried on cradle arms 158 and 159 (not shown). The outside cradle lifter will hit the tip cam 172 as the cradle lifter 152 already has in FIG. 14. Bag 204 has dropped onto conveyor belt 174 and is carried away to be distributed as desired. Conveyor belt 174 is on conveyor frame 173. Bag 206 is shown having already been taken from spout 58 in FIG. 1 and stool and stool support 70. Since take-off device and the bagging machine are driven from the same speed reducer and properly synchronized, the cradle lifter will be able to remove the bags from the spouts and the stool and stool supports at the proper times. Any size bagging machine and associated take-off device could be designed using varying speed ratios. The present take-off device is designed for a 24 spout bagging machine, and has four cradles.

The take-off device for use with a revolving bagging machine basically comprises revolving means operative to revolve the take-off device at a speed proportionate to the speed of revolution of the revolving machine, a plurality of bag carrying means operative to support the bags when the bags are taken from the revolving machine, and positioning means operative to place the plurality of bag carrying means in proper position to remove the bags from the revolving machine. The take-off device further comprises removal means, such as cam 172, to remove the bags from the plurality of bag carrying means.

The revolving means basically comprises motor means, first wheel means physically connected to the output of the motor means and operative to revolve the revolving machine, second wheel means physically connected to the same output of the motor means as is the first wheel means, a center shaft on the take-off device, and shaft driving means connected to the second wheel means and operative to revolve the center shaft of the take-off device.

The motor means basically comprises an electrical motor, such as electrical motor 116, a speed reducer connected to the electrical motor, such as speed reducer 115, and an output shaft emanating from the speed reducer. First and second wheel means are physically connected to the output shaft of the speed reducer 115. The first wheel means may be sprocket 114. The second wheel means may be take-off device drive sprocket 118.

The shaft driving means may comprise a center shaft driving wheel means, such as shaft driving sprocket 121, which is attached to the center shaft 122 of the take-off device. A drive chain, such as take-off device drive chain 119, is driven by shaft driving sprocket 121. The shaft driving means further comprises a drive chain support track, such as drive chain support track 120, and a shaft support structure, such as take-off device shaft support structure 123. The revolving means may revolve the take-off device six times for every one revolution of the revolving machine or may be set up for any multiple of revolutions desired.

The plurality of bag carrying means comprises an outer shaft, such as outer shaft 124, and a plurality of holding means connected to the outer shaft. The plurality of holding means basically comprises a plurality of cradle arm supports, such as cradle arm supports 137, 138, 139, and 140; a plurality of swivel connections, such as swivel connections 145, 146, 147, and 148; and a plurality of bag cradles each connected to one of the plurality of swivel connections. The plurality of bag cradles may comprise a plurality of cradle support sides, such as cradle support sides 168, 169, 170, and 171, and a plurality of back and side arms 160, 161, 162, 163, 164, 165, 166, and 167. The plurality of bag cradles further comprises a plurality of cradle lifters, such as cradle lifters 154, 155, 152, 153, 159, 156, and 157, two of each being connected to two of the plurality of back and side arms which are connected to one of the plurality of cradle support sides. The plurality of holding means further comprises a plurality of cradle arm braces, such as cradle arm braces 141, 142, 143, and 144. The plurality of holding means further comprises a plurality of rigid supports, such as rigid supports 149, 150, and 151.

The positioning means basically comprises movement allowing means which is operative so that the plurality of bag carrying means revolves with the take-off device proportionate to the speed of revolution of the revolving machine, but allows each of the plurality of bag carrying means to be capable of movement up and down. The positioning means further comprises up and down movement means operative to move the plurality of bag carrying means up and down. The up and down movement means basically comprises a base, such as base 411, located at the bottom of the take-off device, and a guiding track, such as guiding track 127, resting on base 411. The up and down movement means further comprises a plurality of wheels, such as wheel 128, which is operative to ride on guiding track 127. Guiding track 127 is structured to provide up and down movement of the plurality of wheels. The guiding track is structured so that a graph of movement of any one of the plurality of wheels versus the time of movement would be a sinusoidal graph.

Movement allowing means basically comprises a slot, such as slot 125, located in outer shaft 124, and a key, such as key 126, located on center shaft 122 and fitting through slot 125 on outer shaft 124, whereby the key 126 causes the outer shaft 124 to revolve with the center shaft 122, but allows up and down movement of the outer shaft 124 along slot 125. The take-off device may be located with respect to the revolving machine so that each pair of the plurality of cradle lifters on the take-off device may remove a bag from one of a plurality of bag supports on the revolving machine. The cradle lifters will go underneath the bag which is resting on stool and stool supports, such as stool and stool supports 171, and due to the up and down movement will lift the bag from the stool and stool support and carry it around the take-off device. Other embodiments to perform the means functions may occur to those skilled in the art and are contemplated by this invention.

The invention comprises a machine for placing material in bags comprising machine revolving means operative to revolve the machine, material holding means in which the material may be held, machine support structure operative to physically support the machine, and material bagging means operative to place the material, held in the material holding means, into the bags. The machine may further comprise bag removal means operative to remove the bags from the material bagging means. The bag removal means may be a take-off device. The machine may further comprise a spill collection device operative to collect any of the material which might escape from the material bagging means. The material holding means may comprise a bagger tank. The bagger tank may comprise an outer surface shaped like a cylinder, an inner sloping interior shell surface circular at the top and bottom, and a bottom connecting the outer surface to the inner sloping interior shell surface. The bagger tank may further comprise a plurality of sloped guide plate surfaces, all of which emanate from the bottom and are physically connected to the outer surface and the inner sloping interior shell surface, each of the plurality of sloped guide plate surfaces with another of the plurality of sloped guide plate surfaces form a void in the bagger tank, whereby none of the material may enter. Each of the plurality of sloped guide plate surfaces with still another of the plurality of sloped guide plate surfaces form a funnel through which the material may flow. The machine may further comprise a cover for the bagger tank operative to prevent particles of the material from escaping into the atmosphere. The cover may contain a plurality of feeder holes through which the material may be placed in the bagger tank. The material holding means may further comprise a plurality of feeder means operative to bring the material to the feeder holes to be deposited in the bagger tank. The bottom may contain a plurality of dump openings through which the material may flow into the material bagging means. The machine revolving means may comprise motor means, wheel means operative responsive to the motor means, and machine driving means operative responsive to the wheel means. The wheel means may comprise a sprocket. The machine driving means may comprise a sprocket chain welded to the machine, whereby when the sprocket is moved by the motor means, the sprocket will mesh with the sprocket chain causing the machine to revolve. The motor means may comprise an electrical motor, a speed reducer connected to the electrical motor, and an output shaft emanating from the speed reducer. The material bagging means may comprise a plurality of impellers, a plurality of housings operative to hold the material which flows from the material holding means, a plurality of impeller shafts each operative to support one of the plurality of impellers, a plurality of impeller shaft turning means each operative to turn one or more of the plurality of impeller shafts, and a plurality of bag holding and filling means operative to hold the bags and to fill the bags with the material. The plurality of housings is operative to house one of the plurality of impellers.

The plurality of impeller shaft turning devices is used to turn the various impellers in the invention. Looking at one impeller shaft turning device which is used in rotating the shaft of an impeller within a housing in a revolving machine, to aid in impelling material into a bag. The impeller shaft turning device comprises motor means operative to rotate the shaft of an impeller, and hydraulic means operative to control the motor means. The motor means may be a hydraulic motor. The hydraulic means may comprise a fluid supply means which provides a flow of fluid to the hydraulic means, start and stop control means operative to start and stop the flow of the fluid to the hydraulic motor, and flow control means operative to control the quantity of fluid to the hydraulic motor after the start and stop control means allow flow of the fluid to the hydraulic motor, whereby the flow control valve controls the speed of rotation of the shaft. The impeller shaft turning device has hydraulic means further comprising pressure relief means operative to maintain constant speed of the hydraulic motor when a plurality of hydraulic motors is operated using the same fluid supply means. The start and stop control means may comprise a directional control valve. The flow control means may comprise a flow control valve. The fluid supply means may comprise a pressure header from which fluid flows to the hydraulic motor and a return header to which fluid flows from the hydraulic motor. The start and stop control means may comprise starting means operative to start the flow of fluid to the hydraulic motor and stopping means operative to stop the flow of fluid to the hydraulic motor. The starting and stopping means, both, may comprise a solenoid. Both the start and stop solenoids may be activated by microswitches. The start solenoid may be activated by a microswitch located on the revolving machine, when the shaft of an impeller should be rotated to aid the revolving machine to impel the material into the bag. The stop solenoid may be activated by a microswitch located on the revolving machine when a pre-determined amount of the material has entered the bag. The pre-determined amount may be determined by a scale beam balance scale system. The flow control means is adjustable to control the flow of the fluid to the hydraulic motor to a predetermined amount per time interval and is thereby operative to control the speed of the hydraulic motor to a pre-determined speed and to be adjusted to control the speed of the hydraulic motor to aid in impelling the material into the bag, which may be necessitated by material of varying particle size and by atmospheric conditions. The fluid supply means may comprise a fluid source means operative to provide a source of fluid, a pressure header from which the fluid may flow to the hydraulic motor, and a return header to which fluid may flow from the hydraulic motor. The fluid source means may comprise a hydraulic pump means connected to the pressure header and operative to pump the fluid to the pressure header, pump motor driving means operative to control the hydraulic pump means, a reservoir operative to hold a supply of fluid, pressure relief means connected to said hydraulic pump means and operative to relieve pressure, and cooling means connected to the return header and operative to cool the fluid when it is returned to the reservoir from the return header. The pump motor driving means may comprise an electrical start and stop switch. The fluid source means further comprises a suction strainer located between the hydraulic pump and the reservoir operative to strain the fluid. The fluid source means may further comprise a filter located between and connected to the return line header and the reservoir to aid in purifying the fluid being returned to the reservoir. The cooling means may comprise a heat exchanger. The pump motor driving means may be an electrical motor. The impeller shaft turning device may further comprise a coupling connected to the output of the motor means and connecting to the shaft of the impeller. The impeller shaft turning device may further comprise a universal joint operative to connect the shaft of an impeller to a second shaft of another impeller, whereby the second shaft of another impeller may be rotated by the same motor means as the shaft of an impeller. The impeller shaft turning device is a sealed system and is impervious to dust and atmospheric conditions.

The revolving machine comprises a plurality of bag holding and filling devices, for placing material into bags. A bag holding and filling device, for placing material into a bag, comprises bag clamping means operative to hold the bag onto the device and pinch means physically connected to the bag clamping means operative to control the flow of the material into the bag, whereby when the pinch means allows the material to flow into the bag, the bag clamping means will hold the bag onto the device and when the pinch means does not allow the material to flow into the bag, the bag clamping means will release the bag. The bag holding and filling device further comprises bag insert interlock contact means operative to cause the pinch means not to allow the material to flow when no bag is being held by the bag clamping means. The bag holding and filling device further comprises weight evaluating means operative when the material in the bag reaches a predetermined weight to activate the pinch means to stop the flow of the material into the bag. The bag holding and filling device further comprises a material flow hose through which the material flows. When the material flow hose is pinched and the material is stopped from flowing by the pinch means, the pinch means operates to stop the flow of material into the bag. The bag holding and filling device further comprises a spout connected to the material flow hose through which the material flows into the bag. The pinch means may be a pinch valve mechanism. The pinch valve mechanism may comprise an air cylinder, an air cylinder control valve operative to control the air cylinder, and a plurality of linkage bars operative responsive to the air cylinder, whereby when the pinch means operates to stop the flow of the material into the bag, the plurality of linkage bars pinches the material flow hose. The bag clamping means comprises a clamping mechanism apparatus operative to clamp the bag against the spout when the bag clamping means is holding the bag onto the device. The bag holding and filling device further comprises a lever rod connected to one of the plurality of linkage bars and to the clamping mechanism apparatus, whereby when the pinch means operates to allow flow of the material into the bag, the lever rod is positioned to press the clamping mechanism against the spout. The bag insert interlock contact means may comprise an electrical contact in the clamping mechanism apparatus, whereby when the clamping mechanism apparatus is pressed against the spout, an electrical connection is made, and a bag insert interlock solenoid valve activated when the electrical contact makes an electrical connection with the spout and operative to activate the air cylinder control valve to cause the plurality of linkage bars to pinch the material flow hose and stop the flow of material, whereby the material will not flow unless a bag, acting as an insulator, prevents an electrical connection between the electrical contact and the spout. The bag holding and filling device further comprises bag support means operative to hold the bag to be filled with the material. The bag support means may comprise a bag channel support connected to the revolving machine, stool support apparatus connected to the bag channel support, and a stool connected to the stool support apparatus operative to hold a bag to be filled with the material. The stool support apparatus may comprise a stool support arm connected to the bag channel support, an adjusting stool support connected to the stool and adjustably connected to the stool support arm, and a plurality of height adjusting nuts operative to hold the adjusting stool support at a pre-determined height, whereby a bag may be placed on the stool and may be raised or lowered by the adjusting stool support to be properly positioned to receive the material into the bag.

Cover 177 for the revolving bagging machine tank reservoir may consist of sheet metal, shaped to enclose the area between outer surface 1 of the bagger tank and inside rim 6. The outside vertical side of cover 177 will extend to a point just inside of the outer surface 1 of the bagger tank and have a lip molded to fit over the top edge of the outer surface 1 of the bagger tank, but not in contact with the top edge. The inner rim of the cover 177 will mate with the top edge of inside rim 6 in a similar manner to the outside vertical side with the outer surface 1 of the bagger tank. This donut-shaped cover 177 will serve the purpose of preventing particles of the material to be bagged from escaping into the atmosphere. The cover 177 will have a plurality of feeder holes, such as feeder hole 178, and a plurality of feeder means, such as feed conveyor 176, as deemed desirable by the user of the bagging machine. The plurality of feeder holes and feed conveyors will enable the bagging machine to bag different grades or types of materials at different times. With the turning action of the machine, the plurality of feeder holes and feed conveyors will act to provide blending of different materials in the tank reservoir. The blending action can be controlled proportionately by controlling the rate of feed from each of the plurality of feeder means.

The cylindrical outer surface 1 of the bagging machine along with the sloping interior shell surface 15, which is circular at the top and bottom, and may be sloped at approximately sixty-five degrees to aid in the flow of the fluidized material; the bottom surface 315 of the bagger tank; and sloped guide supports or surfaces 302, 303, 304, 305, 306, 307, and others not shown, form the main bagger tank reservoir where the material to be bagged is held. The sloped guide supports 302, 303, 304, 305, 306, 307, and others not shown, along with sloped interior shell surface 15, funnel the material to be bagged down into the impeller housings. The sloped guide supports 302, 303, 304, 305, 306, 307, and others not shown, also add strength to the bagger tank being rigidly attached to the bottom surface 315, the inside of outer surface 1, and the sloping interior shell surface 15. The sloped guide supports 302, 303, 304, 305, 306, 307, and others not shown, form the void spaces between the spout assemblies in which hydraulic control apparatuses, air hoses, pipe connections and electrical wiring controls pass. The combination of the inner and the outer flanges of the bottom surface 315 and the area in the voids beside of each dump opening into impeller housings permits the impeller housings to be bolted to the bottom surface 315 without bolts and nuts, such as 316, 317, 318, and others not shown, being located inside of the bagger tank and being covered with material. The outside of interior shell surface 15 of the bagger tank is the location and support for the hydraulic pressure header 284 and the hydraulic return header 283, and also an excellent location for various electrical controls required.

The material to be bagged is funneled down into the impeller housings, such as impeller housings 274 and 275. The impellers in the impeller housings, such as impeller housings 274 and 275, are rigidly attached to the impeller shafts, such as impeller shafts 246 and 247, respectively. The impeller shafts in each of the 24 impeller housings on the bagging machine, having 24 spouts, such as spouts 62 and 63, are coupled together in pairs by the universal joints, such as universal joint 276. The impeller shafts, such as impeller shafts 246 and 247, are rotated within the impeller housings, such as impeller housings 274 and 275, by the hydraulic motors, such as hydraulic motors 242 and 243, through the shaft couplings, such as shaft couplings 244 and 245.

Immediately after the filled bags, such as bag 324, are removed from the bagging machine spouts, such as spouts 62 and 63, by the take-off device, the pinch valve, operative with the spout hose on spout 62, and the pinch valve, operative with the spout hose 337 on spout 63, will be in the clamped position. The clamped position is when the cylinder rods of the pinch valve air cylinders, such as air cylinder 326, are extended through the pinch valve linkage mechnaisms, such as linkage connections 416 and 417, and will move the pinch valve linkage bars, such as linkage bars 334 and 335, close together; and therefore, pinching the sides of the spout hoses, such as spout hose 337, together and stopping the flow of material. The bag clamping mechanisms for the spouts, such as spouts 62 and 63, will be in the unclamped position. The bag clamping mechanisms, such as bag clamping mechanism lever rod 331; pivot pin for clamping mechanism, such as pivot pin 333; clamping mechanism apparatus, such as clamping mechanism apparatus 419; and adjusting bolt, such as adjusting bolt 418; have a pivoting connection (not shown) with the pinch valve linkage bars, such as pinch valve linkage bar 334, and will be in the unclamped position. The same bag clamping mechanisms are shown in the full line drawing with the bag clamping mechanism lever rod shown as clamping mechanism lever rod 330, pivot pin 333, clamping mechanism adjusting bolt, such as adjusting bolt 332, and clamping mechanism apparatus 327, in the clamped position. Thus, when the pinch valve, operative with spout hose on spout 62, and the pinch valve, operative with spout hose 337 on spout 63, are the clamped or pinched position, the bag clamping mechanisms, such as the bag clamping mechanisms operative with spouts 62 and 63, are in the unclamped position.

The hydraulic motor 242 which drives the impellers in the impeller housings 274 and 275, will be stopped and the impellers, attached to the shafts 246 and 247, will not be rotating.

When the bagging machine revolves, moving spout 62, channel support 50, and stool and stool support 74, to a point approximately 4 feet past the position of the take-off device, a bag, such as bag 324, is inserted on spout 62 by a bag insertion means. When spout 63, channel support 51, and stool and stool support 75, reach the same point in their travel around the bagging machine, then a bag, such as bag 324, is inserted on spout 63. When spout 62 is moved approximately 4 feet farther, past the position where a bag was inserted on it, then start air valve 32, mounted on support 20 in approximate vertical alignment with spout 62, will contact stationary cam 422, supported by the surrounding building structures and positioned to contact all start air valves, such as start air valve 32, and all start microswitches, such as start microswitch 42, mounted on supports, such as support 21. Start air valve 32 is activated by contact with stationary cam 422 and actuates air control valve to control the pinch valve associated with the spout hose, similar to spout hose 337, and spout 62. The actuation of the air control valve will unclamp the pinch valve associated with spout 62. The unclamping of the pinch valve associated with spout 62 will move the bag clamping mechanism associated with spout 62 to the clamped position, thereby holding the bag securely to spout 62. The unclamping of the pinch valve will open the spout hose for spout 62, and the material to be bagged will be free to flow into the bag inserted on spout 62.

Further revolving action of the bagging machine will move spout 63 to the position for contact with start air valve 33, supported by support 21, and stationary cam 422. When stationary cam 422 contacts and actuates start air valve 33, then the control mechanisms in air cylinder control valve 325 will cause the pinch valve, operative with spout hose 337, to unclamp, thus allowing the material to be bagged to be free to flow into a bag, such as bag 324, on spout 63.

Also, mounted on support 21 and positioned to contact stationary cam 422 at approximately the same time that start air valve 33 contacts the stationary cam 422, is start microswitch 42. Start microswitch 42 actuates start solenoid 293 which shifts the control mechanisms in the hydraulic four-way directional control valve 282, and thereby allowing the flow of the pressurized hydraulic fluid to the hydraulic motor 242, causing the motor shaft to rotate. The speed of all of the hydraulic motors can be adjusted to a pre-determined revolution per minute by the flow control valves, such as flow control valve 279.

The rotating hydraulic motor 242, through shaft coupling 244, and universal joint 276, drives impeller shafts 246 and 247, and the impellers in the impeller housings 274 and 275. The rotating impellers, in the impeller housings 274 and 275, impel the material to be bagged through the spout openings 277 and 278, through the spout hose assocaited with spout 62, through spout hose 337, and spouts 62 and 63, into a bag inserted on spout 62 and into bag 324 on spout 63. The filling operation of the bags continues until the bag on spout 62 reaches a pre-determined weight, at which time, the weight of the bagged material causes the balance scale system associated with spout 62 to tip or pivot on the knife-edge points, such as knife-edge point 344, and balance scale platform knife-edges, such as balance scale platform knife-edge 349, lifting and over balancing the weight of the counter weight, such as balance scale counter weight 352. The operation of the end of the balance scale mechanisms causes balance support arm contact, such as balance support arm contact 420 associated with the balance scale system and operative with spout 62, to contact and thereby actuate the stop air valve, such as stop air valve 356, operative with the balance scale system on spout 62. The actuation of the stop air valve, associated with the balance scale system and operative with spout 62, will shift the control mechanism in the air control valve for the pinch valve associated with the spout hose for spout 62. The shifting of the control mechanisms, in the air control valve for the pinch valve associated with spout 62, will operate the pinch valve on the spout hose for spout 62, and thereby will shift the pinch valve on the spout hose for spout 62 to the clamped position, stopping the flow of the material into the bag inserted on spout 62.

When the weight of the bagged material in bag 324 on spout 63 reaches the pre-determined weight, the balance scale system associated with spout 63 is tipped or pivoted. The counter weight 352 is lifted along with the associated balance scale support arms, such as support arm 346, and its associated end brackets causing balance scale support arm contact 420 to contact and actuate stop air valve 357 and stop microswitch 356.

When stop air valve 357 is actuated, it operates air control valve 325 for air cylinder 326 to extend the cylinder rod of air cylinder 326 through the pinch valve linkage connections, such as linkage connections 416 and 417, then moves the linkage bars 334 and 335 to the pinched position on hose 337, and thereby stops the flow of the material through hose 337 and spout 63 into bag 324.

When stop microswitch 357 is actuated, it operates stop solenoid 294 to shift the control mechanism in the hydraulic four-way directional control valve 282 and to shut off the flow of the hydraulic fluid to the hydraulic motor 242, and thereby stopping the hydraulic motor 242. The action of stopping the hydraulic motors, such as hydraulic motor 242, will tend to prevent the material from becoming packed in the impeller housings, spout hoses, and spouts, such as spouts 62 and 63.

The interval of time between the time when the bags are filled and the de-activation of the filling operation, and the time when the take-off device starts to remove the bags from the bagging machine spouts, will, through air holes, such as holes 410 in bag 324, permit the air which is impelled into the bags, such as bag 324, along with the bagged material, to escape.

The operation of the bagging machine and the take-off device is synchronized so that four spouts of the bagging machine pass the position where the bags, such as bags 204, 205, 206, and 207, are removed from the spouts, such as spouts 58, 59, 60, and 61, and others, for each revolution of the take-off device. The bagging machine and the take-off device drive system are synchronized so that the position of removal of a bag, such as bag 206; a track arm, such as track arm 132; a flange wheel, attached thereto; a cradle arm support, such as cradle arm support 140; and the attached cradle mechanisms, supported thereby, will be aligned between the center shaft 4 of the bagging machine and the center shaft 122 of the take-off device. The guide track 127, supported by the base of the take-off device 411, is designed and positioned so that the wheel on the track arm support, such as track arm support 132, is at the low point on the sinusoidal path of travel at the time when the cradle lifters, such as cradle lifter 156 and 157, and the back and side arms, such as back and side arms 166 and 167, are in full contact with a bag, such as bag 206. The position referred to above is the position of the removal of a bag. The cradle lifters, such as cradle lifters 156 and 157, will be positioned under a bag, such as bag 206, and on each side of a stool and stool support, such as stool and stool support 70. As the bagging machine and the take-off device revolve, the flange wheels, such as the flange wheel attached to a track arm support, such as track arm support 132, move and climb on the ascending section of the guide track 127. The climbing action lifts the outer shaft 124 and all the mechanisms supported thereby, thus lifting the bag, such as bag 206, off of its supporting stool, such as stool and stool support 70. The bagging machine and the take-off device revolve so that the bags are moved away from the bagging machine, after the bags start being removed from the bagging machine by the take-off device. The cradle lifters, such as cradle lifter 157, are carried up and over the top of the stool and stool support, such as stool and stool support 70, by the tangential movement of the bagging machine and the take-off device away from each other, after the bags, such as bag 206, are removed.

The bags, such as bag 206, are carried around on the take-off device by the cradle mechanisms, such as the cradle mechanisms attached to the cradle arm supports, such as cradle arm support 140, to a position where the cradle lifters, such as cradle lifter 157, contacts the tip cam 172. Tip cam 172 is positioned so as to contact the cradle lifters on the take-off device, and by the rotating action of swivel connections, such as swivel connection 148, will cause the bags, such as bag 206, to be dumped on conveyor belt 174 to be carried away for further processing. The removal of each bag is a repeated cycle of the operation described above.

The same general configuration of the 24 spout bagging machine and its mode of operation is easily adapted to machines of different numbers of filling spouts. Most of the individual parts and members could be identical in size and function.

However, several items would need to vary primarily in size on machines of different numbers of filling spouts. On the 18 spout machine, the angle between spouts would be 20° in lieu of 15° for the 24 spout machine. On the 12 spout machine, the angle between the spouts would be 30° in lieu of 15° for the 24 spout machine. The main driving speed reducer and sprocket would be sized for the best adaption to the particular machine, and therefore, speed ratios of units would need to be adjusted. The overall diameter of the driving ring gear and tank reservoir would need to be changed to maintain proper spacing of the spouts in the distance around the tank reservoir. The number of impeller driving hydraulic motors would need to be changed. This change would be caused by the fact that the bending of the universal joints more than fifteen degrees at a speed of twelve thousand r.p.m.s. is not feasable with the universal joints presently on the market today. The size of the hydraulic pump and other hydraulic accessory equipment would need to be sized to suit the requirements of the desired machine.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. An impeller shaft turning device for use in rotating the shaft of an impeller within a housing in a revolving machine to aid in impelling material into a bag comprising motor means operative to rotate said shaft of an impeller, hydraulic means operative to control said motor means, said hydraulic means comprising fluid supply means providing a flow of fluid to said hydraulic means; start and stop control means operative to start and stop flow of said fluid to said hydraulic motor; flow control means operative to control the quantity of fluid to said hydraulic motor after said start and stop control means allow flow of said fluid to said hydraulic motor, whereby said flow control valve controls the speed of rotation of said shaft; said fluid supply means comprising fluid source means operative to provide a source of fluid; a pressure header from which said fluid may flow to said hydraulic motor; a return header to which fluid may flow from said hydraulic motor; said fluid source means comprising:

a. hydraulic pump means connected to said pressure header and operative to pump said fluid to said pressure header;
b. pump motor driving means operative to control said hydrulic pump means;
c. a reservoir operative to hold a supply of fluid;
d. pressure relief means connected to said hydraulic pump means and operative to relieve pressure;
e. cooling means connected to said return header and operative to cool said fluid when it is returned to said reservoir from said return header.

2. An impeller shaft turning device according to claim 1 wherein said pump motor driving means comprises an electrical start and stop switch.

3. An impeller shaft turning device according to claim 1 wherein said fluid source means further comprises a suction strainer located between said hydraulic pump and said reservoir operative to strain said fluid.

4. An impeller shaft turning device according to claim 1 wherein said fluid source means further comprises a filter located between and connected to said return line header and said reservoir to aid in purifying said fluid being returned to said reservoir.

5. An impeller shaft turning device according to claim 3 wherein said fluid source means further comprises a filter located between and connected to said return line header and said reservoir to aid in purifying said fluid being returned to said reservoir.

6. An impeller shaft turning device according to claim 5 wherein said pump motor driving means comprises an electrical start and stop switch.

7. An impeller shaft turning device according to claim 1 wherein said cooling means is a heat exchanger.

8. An impeller shaft turning device according to claim 1 wherein said pump motor driving means is an electrical motor.

9. An impeller shaft turning device according to claim 1 wherein said impeller shaft turning device further comprises a universal joint operative to connect said shaft of an impeller to a second shaft of another impeller, whereby said second shaft of another impeller may be rotated by the same motor means as said shaft of an impeller.

10. An impeller shaft turning device according to claim 1 wherein said impeller shaft turning device further comprises a universal joint operative to connect said shaft of an impeller to a second shaft of another impeller, whereby said second shaft of another impeller may be rotated by the same motor means as said shaft of an impeller.

* * * * *